US009975609B2

(12) United States Patent
Fitzpatrick et al.

(10) Patent No.: US 9,975,609 B2
(45) Date of Patent: May 22, 2018

(54) SHIP FOR GAS STORAGE AND TRANSPORT

(71) Applicant: SEA NG CORPORATION, Calgary (CA)

(72) Inventors: John Fitzpatrick, Calgary (CA); David Stenning, Calgary (CA)

(73) Assignee: GEV Canada Corporation, Calgary, Alberta (CA)

( * ) Notice: Subject to any disclaimer, the term of this patent is extended or adjusted under 35 U.S.C. 154(b) by 0 days. days.

(21) Appl. No.: 15/316,933

(22) PCT Filed: Jun. 11, 2015

(86) PCT No.: PCT/CA2015/050540

§ 371 (c)(1),
(2) Date: Dec. 7, 2016

(87) PCT Pub. No.: WO2015/188276

PCT Pub. Date: Dec. 17, 2015

(65) Prior Publication Data

US 2017/0106948 A1 Apr. 20, 2017

Related U.S. Application Data

(60) Provisional application No. 62/010,924, filed on Jun. 11, 2014.

(51) Int. Cl.

| | |
|---|---|
| ***B63B 25/14*** | (2006.01) |
| ***F17C 1/00*** | (2006.01) |
| ***F17C 5/06*** | (2006.01) |

(52) U.S. Cl.

CPC ..... *B63B 25/14* (2013.01); *F17C 1/002* (2013.01); *F17C 5/06* (2013.01); *F17C 2201/0138* (2013.01); *F17C 2201/0157* (2013.01); *F17C 2205/013* (2013.01); *F17C 2209/221* (2013.01); *F17C 2223/0123* (2013.01); *F17C 2225/0123* (2013.01); *F17C 2260/036* (2013.01); *F17C 2270/0105* (2013.01)

(58) Field of Classification Search

CPC ..... B63B 25/00; B63B 25/02; B63B 25/08; B63B 25/14; B63B 25/16; B63B 25/22; F17C 1/002; F17C 5/06

USPC ..... 114/72, 73, 74 A, 74 R

See application file for complete search history.

(56) References Cited

U.S. PATENT DOCUMENTS

| | | | |
|---|---|---|---|
| 3,830,180 | A | 8/1974 | Bolton |
| 5,450,806 | A | 9/1995 | Jean |
| 5,803,005 | A | 9/1998 | Stenning et al. |
| 5,839,383 | A | 11/1998 | Stenning et al. |

(Continued)

FOREIGN PATENT DOCUMENTS

| | | |
|---|---|---|
| CA | 2283008 | 9/1999 |
| EP | 0767338 A2 | 4/1997 |

OTHER PUBLICATIONS

Lucy Hine, Oct. 2, 2009, p. 32-33, Trade Winds, Trade Winds Business Report: LNG, London.

*Primary Examiner* — Lars A Olson
(74) *Attorney, Agent, or Firm* — Gable Gotwals

(57) ABSTRACT

A ship for transporting cargo gas, such as natural gas, includes a ship structure and a middle transverse bulkhead constructed by gas storage containers. Each gas storage container includes an enclosure and a pipe coil within the enclosure that contains the cargo gas and it is the enclosures of the gas storage containers that are integrated into the ship structure to form the middle transverse bulk head.

35 Claims, 12 Drawing Sheets

(56) References Cited

U.S. PATENT DOCUMENTS

| | | | |
|---|---|---|---|
| 6,003,460 | A | 12/1999 | Stenning et al. |
| 6,240,868 | B1 | 6/2001 | Fitzpatrick et al. |
| 2010/0058780 | A1 | 3/2010 | Yoo et al. |
| 2012/0138153 | A1 | 6/2012 | Fitzpatrick |
| 2015/0330569 | A1 | 11/2015 | Fitzpatrick |

SHIP FOR GAS STORAGE AND TRANSPORT

FIELD OF THE INVENTION

The invention relates to ship structures for gas storage and transport, and methods for their manufacture, particularly for the storage and transport of compressed natural gas.

BACKGROUND OF THE INVENTION

Gases such as industrial gases and fuels must sometimes be transported from a production site to a site for use.

Natural gas must often be transported from a production site to a consumption site. There are known options of transporting natural gas, such as across bodies of water including for example, through pipelines or via ship transport as liquefied natural gas (LNG) and ship transport as compressed (non-liquefied) natural gas (CNG), (While these fluids may have the properties of a liquid, they are commonly generally referred to as gases.)

Transport costs are always a factor. However, costs must particularly be considered in situations where the gas volumes produced at the production site are small. This is true of natural gas, where some formations produce only small quantities.

Recently, the current applicant has suggested ship structures for storing and transporting gas storage structures therein, such as those described in U.S. Pat. No. 5,803,005 and U.S. Pat. No. 5,839,383.

SUMMARY OF THE INVENTION

In accordance with an aspect of the present invention, there is provided a ship for transporting gas comprising: a ship structure including a hull including a port side structure, a starboard side structure, a deck structure and a bottom structure; a forward end bulkhead; and a rear end bulkhead; and a middle transverse bulkhead spaced between the forward end bulkhead and the rear end bulkhead, the middle transverse bulkhead including: a) at least one stack of gas storage containers, each stack including a lowermost gas storage container and an uppermost gas storage container, each of the uppermost gas storage container and the lowermost gas storage container including a construction including: an enclosure and a cargo gas storage pipe within the enclosure, the cargo gas storage pipe being a substantially continuous pipe coiled in plural layers, each of said plural layers including plural loops of said pipe; and connections configured to integrate the at least one stack of gas storage containers into the ship structure including (i) connections between the enclosures of the at least one stack of gas storage containers and each of the port side structure and the starboard side structure, (ii) a connection between the enclosure of the uppermost gas storage container and the deck structure, and (iii) a connection between the enclosure of the lowermost gas storage container and the bottom structure.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF VARIOUS EMBODIMENTS

Figure 1:
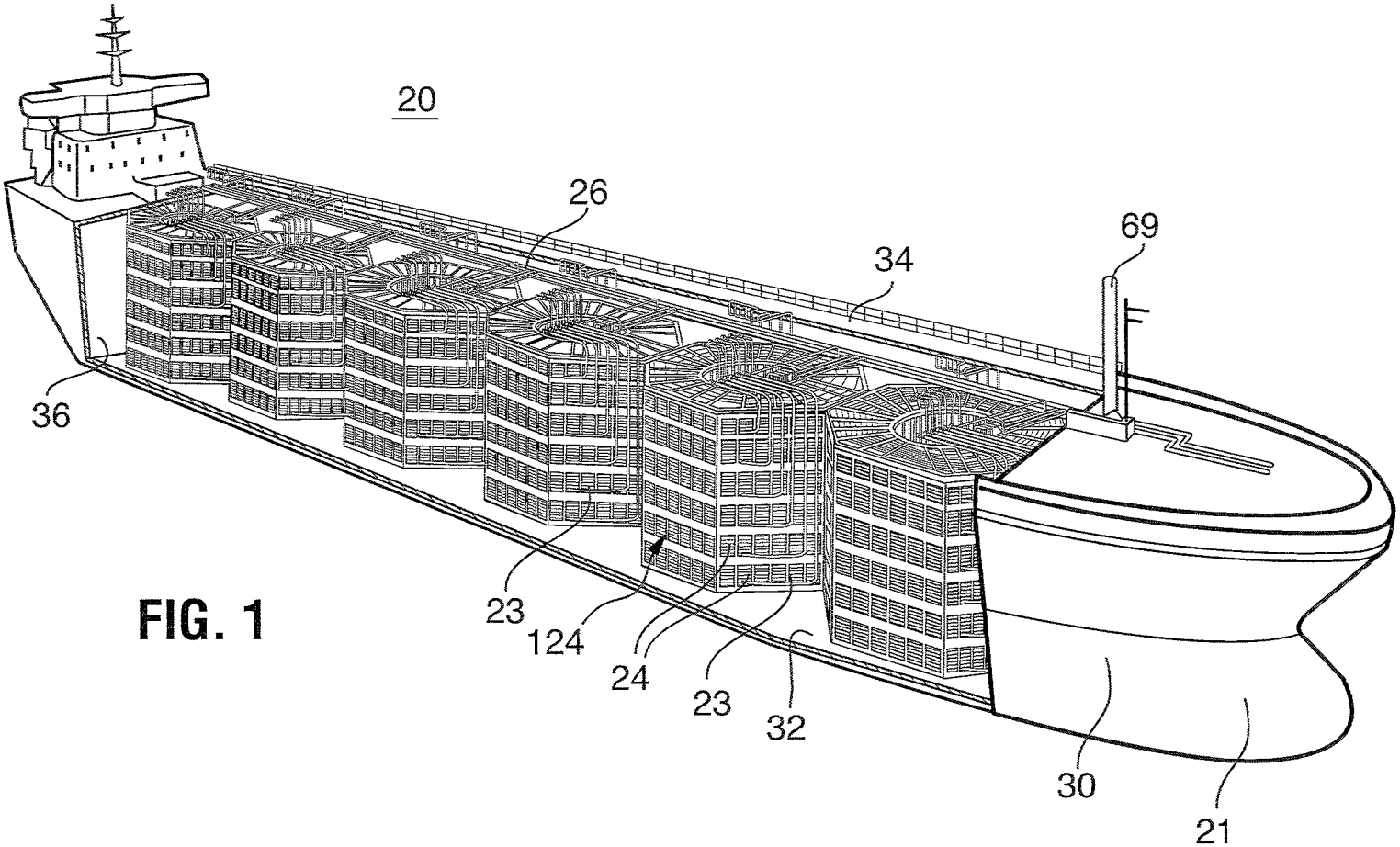
FIG. 1 is a perspective view, partly cut away, showing a ship with built-in gas storage containers in its hold according to an embodiment of the invention.

The description that follows and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

A ship has been invented. The ship includes a plurality of storage containers that may be employed to store gas to be transported as cargo by the ship and the gas storage containers are integrated into the ship to form part of the ship structure. Particularly, the gas storage containers are integrated with the ship structure to construct one or more bulkheads.

A gas storage container particularly adapted for transportation of large quantities of compressed gas, may include a large storage volume provided by coils of substantially continuous pipe within an enclosure.

The gas storage containers act to transport a gas, but their enclosures can be connected to the ship structure to act as part of the ship structure. The gas storage containers replace other ship structures such as traditional transverse and longitudinal bulkheads to reduce the ship weight and cost.

In one embodiment, the ship employs a plastic catenary design wherein the steel of the hull and connections within the hull are strong and highly ductile. Ductility mitigates rupture of the hull. The present ship may be constructed with high strength, high ductility steel and using hull structural reinforcements that are based on T-sections with substantially symmetrical T-flanges. In addition, intersections where reinforcements meet may be reinforced, as for example, by welding and/or collaring.

A ship 20 according to an embodiment of the present invention is shown in FIG. 1. Ship 20 is substantially symmetrical about a central long axis x so while the description herein may sometimes only refer to the structure and construction of one side of the ship (i.e. the starboard side), it is understood that the same also applies to the other side (i.e. the port side).

Figure 10:
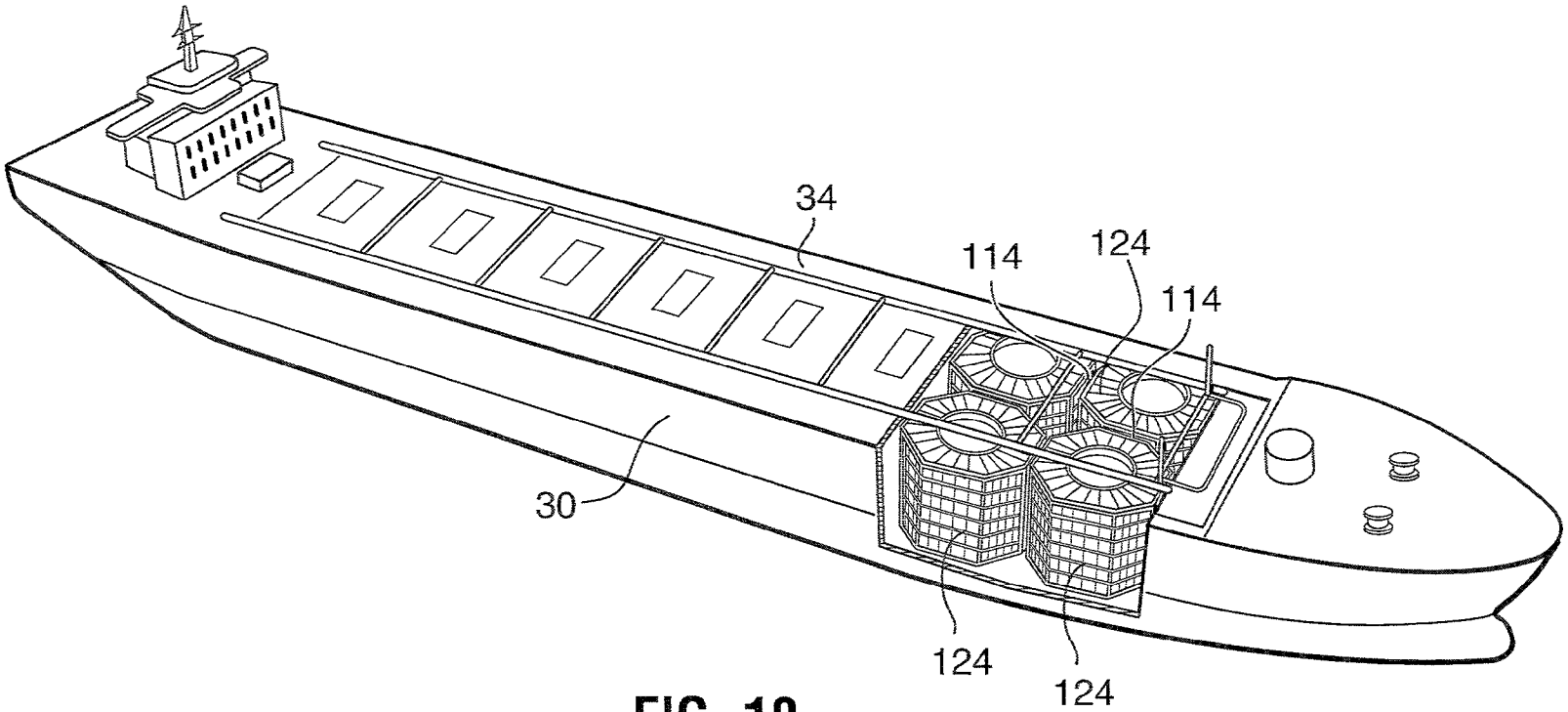
FIG. 10 is a perspective view, partly cut away, showing a ship with built-in gas storage containers according to another embodiment of the invention.

Ship 20 has a hull 21 defining therewithin a hold 22. The hold accommodates and has integrated therein a plurality of gas storage containers 24. The illustrated hold 22 may be, for example, about 100 ft wide and 700 ft long. However, other sizes are possible, one of which, for example, is shown in FIG. 10.

Figure 2A:
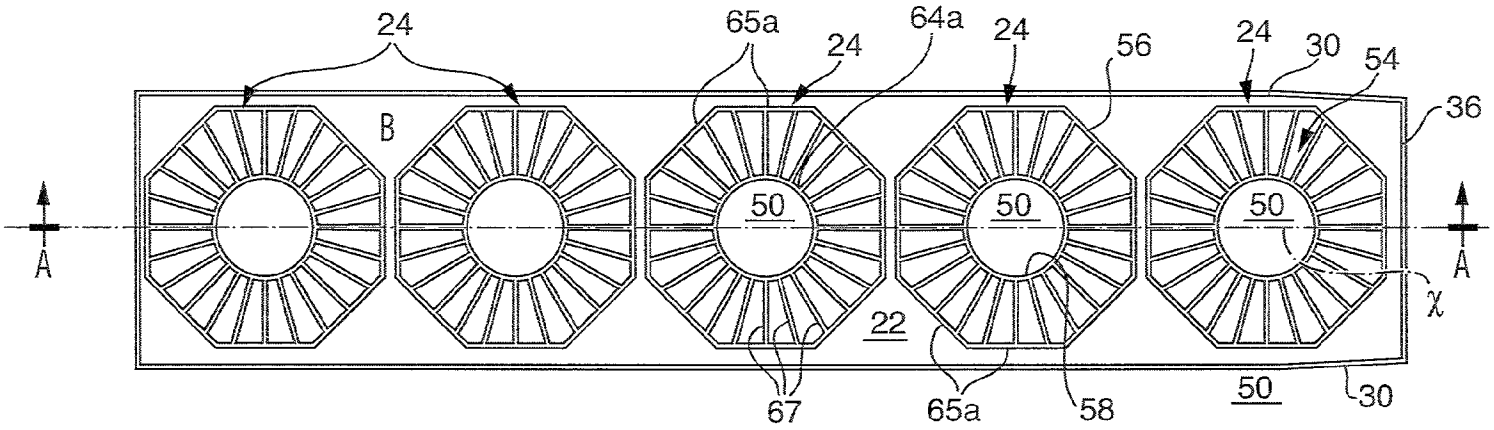
FIG. 2*a* is a schematic plan view showing the hold of the ship having five gas storage containers according to an embodiment of the invention.
Figure 2B:
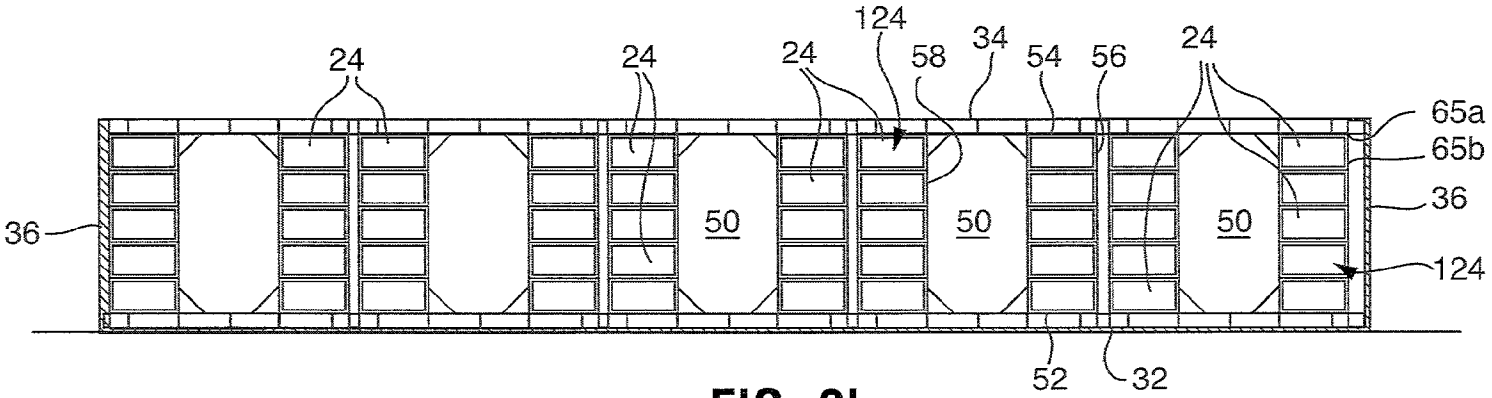
FIG. 2*b* is a section view along the line A-A of FIG. 2*a*, through the mid-section of the five gas storage containers.
Figure 3:
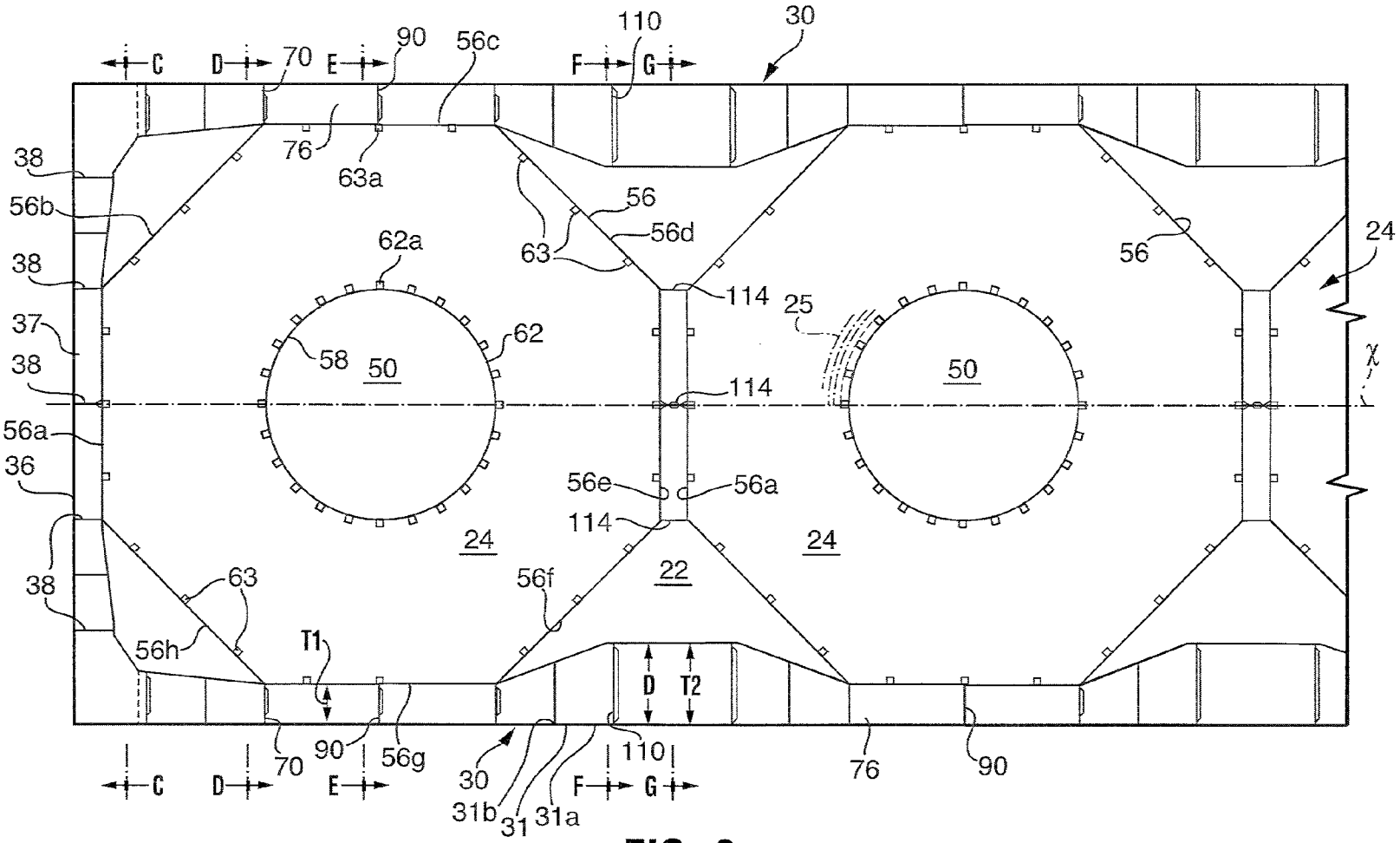
FIG. 3 is an enlarged view of the shaded area B of FIG. 2*a;*

With reference as well to FIGS. 2*a*, 2*b*, and 3, hold 22 is framed by two side structures 30, a bottom structure 32, a deck structure 34, and a forward and a rear end bulkhead structures 36 (only the rear end bulkhead structure is shown in FIG. 1). Side structures 30, bottom structure 32 and deck structure 34 continue axially forward and axially rearward of forward and rear end bulkhead structures 36 to form the bow and the stern, respectively, of the hull.

Each structure 30, 32 and 34 has shell plating 31 on one side, providing an exterior surface, and reinforcements (web frames, girders, longitudinals, floors, etc.) on the other side (i.e. the interior side). For example, referring to FIG. 3, side structure 30 includes shell plating 31, which on one side 31*a* is substantially smooth, without additional features connected thereto. Side 31*a* is the exterior side of the side structure and, in fact, forms the outer surface of the ship's hull. The opposite, inner facing side 31*b* of the shell plating, is supported on structural reinforcements such as longitudinals 44, 76 and web frames 70, 90, 110, as will be described in more detail herein after.

Forward and rear end bulkhead structures 36 each also include shell plating and reinforcements by which the shell plating is supported.

As noted, hold 22 accommodates a plurality of gas storage containers 24. In the illustrated embodiment, there are five stacks 124 of storage containers 24 aligned along the length of the hold. However, the hold may have more or fewer containers per stack and/or more or fewer stacks of storage containers and the arrangement of the stacks within the hold may also vary, depending on the size of the ship's hold and the size of the containers and/or stacks. For example, FIG. 10 shows two longitudinal, axially aligned lines of container stacks in the hold, with the stacks in the two lines being positioned side by side transversely along the length of the hold between the end bulkheads. The stacks, thus, fill the hold in a cubic arrangement in plan view when considering the vertical center point of each stack.

The gas storage containers 24 each include an enclosure and a coil of pipe, shown in phantom as 25 (FIG. 3), within the enclosure. The coil of pipe contains the gas to be transported (i.e. cargo gas). The gas storage containers are designed to safely accept the pressure of compressed gas, which may range between 1000 to 5000 psi, to be set by optimization taking into account the type of gas-containing pipe, the shipping costs, etc. and the physical properties of the cargo gas. It is preferred that the values be in the range of 2500 to 4500 psi. For transport of compressed natural gas (CNG) in the embodiment described, the maximum pressure is generally 4000 psi.

The coil of pipe is substantially continuous pipe. The use of long lengths of substantially continuous pipe for gas storage leads to a significantly reduced cost as less interconnecting equipment is required between gas storage containers. The use of small diameter pipe of less than 6 inch diameter also provides an increased level of safety over larger sized pressure vessels. In particular, the continuous gas storage pipe, which has a length to diameter ratio of greater than 1000, h The gas storage containers are designed to safely accept the pressure of compressed gas, which may range between 1000 to 5000 psi, to be set by optimization taking into account the cost of pressure vessels, ships, etc, and the physical properties of the gas. It is preferred that the values be in the range of 2500 to 4500 psi. For CNG storage and transport, the maximum pressure is generally 4000 psi.

The gas storage container, particularly adapted for transportation of large quantities of compressed gas, may include a large storage volume provided by coils of substantially continuous pipe within an enclosure. The use of long lengths of substantially continuous pipe for gas storage leads to a significantly reduced cost as less interconnecting equipment is required between gas storage containers. The use of small diameter pipe of less than 6 inch diameter provides an increased level of safety over larger sized pressure vessels. In particular, the continuous gas storage pipe, which has a length to diameter ratio of greater than 1000, has a significantly better safety rating than large sized cylinders.

It is understood that the material employed to make the continuous pipe used in the gas storage containers will be ductile and not brittle at operational fluid transport pressures and temperatures, and that the material is impervious to gas stored within the continuous pipe. It will also be understood that while very long lengths of pipe are ideal, it may be necessary to make intermediate joints between long pipe sections to facilitate manufacturing. By substantially continuous, therefore, it is noted that the pipe may from time to time include joints where one supply of pipe is joined to a next supply of pipe. The continuous pipe may be fabricated from any normal grade of steel, for example X70.

Gas loading and unloading lines 23 are installed to connect between the gas storage coil of pipe 25 within each container 24 and the ships external loading/unloading pipes 26.

The enclosure supports the coil of pipe 25. The pipe is coiled within the enclosure and there is space around the pipe, between the pipe and the enclosure, to allow expansion and retraction of the pipe such as due to loading and unloading of gas and temperature and pressure fluctuations in the within and about the pipe. Other than at its ends, the pipe is free of connections to the enclosure to facilitate the expansion and retraction of the pipe and to ensure than stresses on the enclosure are not transferred to the pipe coil 25.

The enclosure may be airtight to provide secondary containment, should a leak develop in the coil. The enclosure is strong, having a rigid construction of walls formed of support beams and panels.

Since the enclosure is likely constructed outside of the ship, the enclosure may include eyes or other structures to be connected to a crane for lifting into place within the hull. The enclosure is able to retain its shape and to support the coil even when lifted in this way.

In one embodiment, the enclosure has a base 52, an outer storage sidewall 56, an inner storage sidewall 58 and a top 54. In the embodiment illustrated herein, the container is shaped in plan view in the form of a ring with an octagonal outer perimeter shape. Thus, container has an exterior three dimensional shape that may be defined as an octagonal prism with a hole 50 extending vertically therethrough, that hole being defined within the inner storage side wall 58 that forms a central core for the container. The container, thus, acts as a support into which continuous pipe 25 may be wound in plural loops and in plural layers around the core, for example, employing a hose reel coiling type of winding.

Figure 6A:
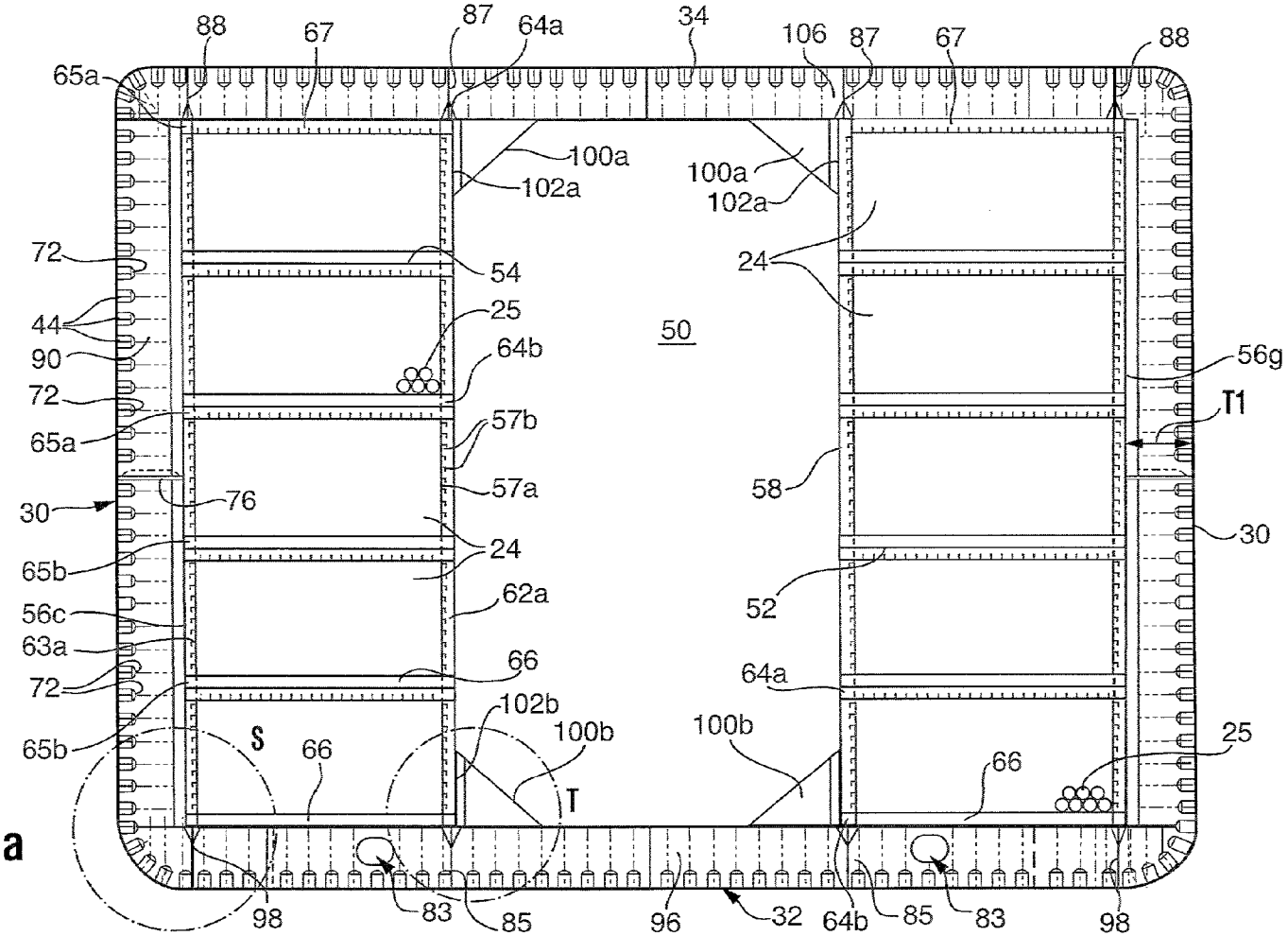
FIG. 6*a* is a section view along line E-E of FIG. 3.

The enclosures are strong, able to support the coiled pipe, even when lifted to move the container including the enclosure and full load of coiled pipe. The enclosures are also able to withstand significant applied weight, such as due to stacking. The containers 24 may be arranged in stack 124, such that there are, for example, about three to eight containers 24 stacked as illustrated in FIGS. 2*b* and 6*a*. Each container may be 8 to 14 feet high and 30 to 90 feet in outer diameter. The number of containers in a stack, and thereby the total height of the stack of containers 24, is limited mainly by considerations of ship size and stability.

In a stack, the walls 56, 58 of the lower containers support the upper containers. As further illustrated in FIG. 3, the container's side walls 56, 58 may include columns. For example, side wall 58 may be formed of vertical columns 62 and side wall 56 may be formed of vertical columns 63. Referring to FIG. 6*a*, the base 52 of the container 24 also includes beams such as for example box beams 66. The beams 66 may be radially oriented, for example, connecting radially aligned ones of the inner columns 62 and the outer columns 63. Referring to FIG. 2*a*, the top 54 of the container may also include radial beams 67, which may extend between inner and outer columns 62, 63.

Referring to FIGS. 2*a*, 3 and 6*a*, the vertical columns 62 may be connected at their ends with ring beams 64*a*, 64*b* and the vertical columns 63 may be connected at their ends with upper and lower ring beams 65*a*, 65*b*. Radial beams 66 of the base extend between ring beams 64*b*, 65*b* and radial beams 67 of the top 54 extend between ring beams 64*a*, 65*a*.

The base 52, side walls 56 and 58 and top 54 of the container 24 may be sealed so as to be air tight. Thus, the interior of the container within the base, the top and the side walls is an air tight seal. This air tight seal provides the container 24 with a safety containment function in relation to fluids carried by the continuous pipe. Should those fluids leak from continuous pipe 25, they will enter the interior of the container and are vented via vent lines and a vent stack 69. In addition, the interior of the container, within the base, the top and the side walls, may act to store fluid, apart from a leak. For example, while the gas containing pipe is arranged inside the container, the air tight construction of the container walls permits the container to be filled about the pipe 25 with a dry inert gas such as nitrogen, air or exhaust gases.

Thus, in one embodiment, for example, the walls 56, 58 and base 52 may include panels 57*a* sealed so as to be impervious to leakage of fluid into or out of the container through those walls. The containers 24 may each also include sealed top panels. However, if the containers are intended to be in a stack as shown in the Figures, the top seal of a lower container in the stack may be provided by the base 52, including the beams and panels, of the container above, with only the uppermost container having a top panel installed. Regardless, the top panel, however formed, completes the fluid tight enclosure for the container.

The panels may include various forms of stiffening ribs 57*b* to improve their pressure holding capability and strength.

Overall the container's enclosure of columns, radial beams and ring beams, along with the panels 57*a* and ribs 57*b* creates a very strong structure with significant resistance to distortion by lateral or axial loads. (Panels and ribs are removed from many of the Figures to facilitate illustration of structural members.) Panels 57*a* may be formed of high strength, high ductility steel such as EH36 steel, as this ensures excellent strength even at very low temperatures. For example, EH36 steel is manufactured by an on-line accelerated cooling process and exhibits high fracture toughness at temperatures down to −60 C.

While each of the containers 24 provides a fluid tight interior space, the containers may be stacked and connected together such that the stack, as well, is fluid tight. Thus, the containers may be connected such that the resulting stack is both vertically stable and overall fluid impervious both into/out of the individual containers, but as well fluid impervious through the stack between containers in the stack. For example, the interface between adjacent containers in the stack can be sealed as by welding, coating or filling to be fluid tight. Such a seal 79, however formed, may extend about the area that needs to be sealed, for example, at the interfacing space between the two containers about the full circumference of the containers. Seals 79 may be formed between all adjacent containers in the stack such that the entire stack is impervious to fluid leakage into or out of the hole 50 in the middle of the stack. In particular, the external wall of each stack is formed to be impervious to fluids leaking therepast. For example, when stacking a container on top of a lower container, a weld may be made between the upper ring beam 65*a* on the lower stack and the lower ring 65*b* beam on the upper container to seal the interface. The weld at the interface may be directly between the parts or may attach a covering such as an elongate plate to cover and seal the interface. The seal may extend about the entire circumference of the containers at their interface between the parts, for example, about the entire lengths of the adjacent ring beams. The resulting fluid tight stack wall is of great value to the integration of the containers to the ship, as the stacks can act as fluid tight bulkheads.

As mentioned above, in the illustrated embodiment, outer wall 56, by formation of upper and lower ring beams 65*a*, 65*b* and placement of columns 63, is formed as an angular cylindrical shape. In the illustrated embodiment, for example, the container is formed as an octagon in plan view. As such, the container has an exterior shape that may be defined as an octagonal prism. Other exterior shapes, including circular and other polygonal shapes, are possible. The stack is formed with the flat exterior sides 56*a*-56*h* of each container aligned with flat exterior sides of the containers above and below such that the overall stack also takes the form of an octagonal prism with eight vertically extending flat sides and a center vertical hole.

The exterior polygonal walls of the stacks have been found to facilitate construction and are particularly useful in the present invention, as they permit connection of each stack of containers to adjacent stacks and to the ship. For example, the aligned flat sides 56*a*-56*h* forming the polygonal exterior wall of each stack can be oriented facing and connected to the flat side of an adjacent stack 124 and/or to the substantially flat surfaces the side structures 30 or end bulkheads 36 defining the hold. A number of connections can be made between those facing flat sides and the facing flat surfaces to securely hold the containers together and in position in the hold.

For example, the octagonal prismatic shape fits conveniently in groups and within rectangular spaces. The shape provides a number of exterior, flat side surfaces that provide expansive space for connections to adjacent substantially flat surfaces. In particular, each stack of containers, being shaped as an octagonal prism, has eight planar sides 56*a*-56*h*. To secure the stack between two adjacent confining surfaces such as side structures 30, two diametrically opposed sides, such as sides 56*c*, 56*g* may be connected to the structures 30. In particular, when placed in a cubic space, such as the hold, four sides of the eight sides can be connected to other structures, such as the end structure 36, the side structures 30 and a side of an adjacent container. Referring to FIG. 3, for example, the stack of storage containers on the left side of the drawing has a first side 56*a* connected to the end structure 36, another side 56*c* connected to one of the side structures 30, side 56*g*, which is diametrically opposite to side 56*c*, connected to the other side structure 30 and another side 56*e*, opposite to the first side 56*a*, connected to a side 56*a* of the stack adjacent thereto. With four sides connected to other structures, a rigid, strong integration of the stack within the hold is achieved. Each stack also has four unconnected sides 56*b*, 56*d*, 56*f*, and 56*h*, which remain open and accessible in the hold, through which connections can extend, workman can gain access to the stack, etc.

The stack is therefore integrated into the ship's hull by direct connection to the bottom structure and deck structure and by connection to the side structures (if not connected directly to a side structures, the stack is indirectly connected through an adjacent stack to both side structures). The stack thereby becomes a part of the ship structure operating as a middle transverse bulkhead.

The stacks 124, as shown in FIG. 1, may each be connected between and directly to side structures and are connected one to the next in series along the long axis. In larger ships, it is possible that more containers can be accommodated between the side structures. For example, as shown in FIG. 10, the stacks of containers may be positioned and connected side by side, transversely between side structures 30 and in series between end bulkheads 36. The stacks may also be arranged in other patterns, such as hexagonal patterns.

The gas storage containers 24 are configured to connect to any adjacent ones of side structures 30, bottom structure 32, deck structure 34, end bulkhead structures 36, and/or a side of an adjacent container, so that the containers can be integrated with the structure of the hold. By constructing the hold of a ship in the manner described herein, transverse bulkheads along the length of the ship are formed by the stacks of containers, such that it is not necessary to add transverse bulkheads separately. Additionally, longitudinal bulkheads are formed by connecting the stacks of the gas storage containers together in series, connecting the rearmost stack to the rear end transverse bulkhead and connecting the frontmost stack to the forward end transverse bulkhead.

The integration of the container stacks into the ship structure to form the bulkheads may reduce the amount of material that is required to construct the ship, especially the hold section, thus reducing the total weight and cost of the ship. Further, eliminating the need for separate bulkheads by integrating the containers with the hold structure helps to maximize the gas storage capacity of the ship, as the configuration of container placement in the hold is not obstructed by separate, traditional bulkheads.

End bulkhead structures 36 are employed, however, that are not formed of gas storage containers. Each end bulkhead structure is constructed of plating steel supported by reinforcements and without any gas storage capabilities. One end bulkhead structure 36 is positioned at each end of the hold, to offer a strong end connection site for the endmost stacks in the longitudinal bulkheads, to fluid isolate the hold from chambers within the bow and the stern, for containment both of cargo gas leaks and impact damages. To ensure that the end bulkhead structures can act in these ways, they are formed to be substantially as strong as the hull. For example, the end bulkhead structures 36 can each have a pressure holding capacity of about 50 psi and in some cases possibly up to about 100 psi. The construction and further details of structures 36 are described in greater detail herein after.

In the illustrated embodiment, the hull is constructed as a single hull, with a single layer of shell plating 31. Although a double hull, with multiple layers of shell plating, may be employed, the integration of containers 24 with the ship's side wall and floor structures strengthens the hull such that a double hull is not required. The outer hull can have a pressure holding capacity of about 50 psi and in some cases possibly up to about 100 psi and may be constructed, for example, with plating 31 of high strength, high ductility steel, such as a steel with properties similar to EH36 steel, and as such, the hull is much stronger and more resistant to breach than many comparable sized ships.

Vertical and longitudinal reinforcements support the ship's shell plating 31. For example, side structure 30 has a plurality of longitudinals, such as reinforcement ribs 44 and stringers 76 on its interior-facing side. The ribs 44 and stringers 76 extend substantially parallel to axis x longitudinally along the length of the side structure at least extending continuously between the front end bulkhead and the rear end bulkhead and normally beyond those bulkheads at each end fully to the bow and the stern. Reinforcement ribs 44 and stringers 76 are spaced apart along the height of side structure 30, between the deck structure 34 and the bottom structure 32.

Web frames 70, 90, 110 intersect the longitudinals and provide the vertical support as they extend along the side structures from bottom structure 32 to deck structure 34. Web frames 70, 90, 110 are spaced apart along the length of the hull and are substantially aligned from one side structure to the other.

Shell plating 31 is supported externally of longitudinals 44, 76 and web frames 70, 90, 110.

Figure 6B:
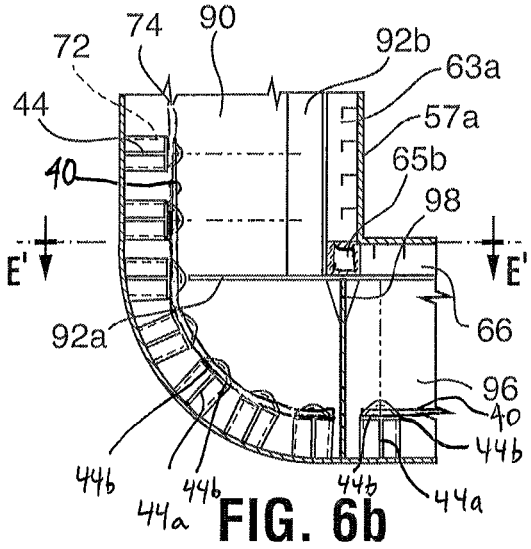
FIG. 6*b* is a magnified view of area S of FIG. 6*a;*
Figure 6C:
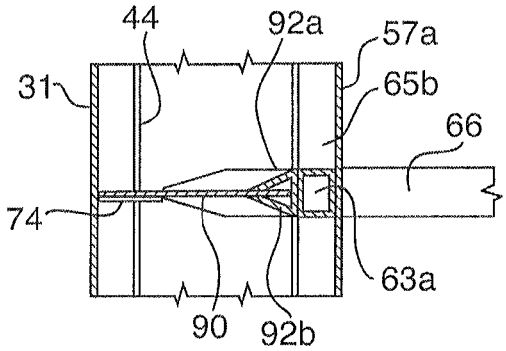
FIG. 6*c* is a section view along line E'-E' of FIG. 6*b;*
Figure 6D:
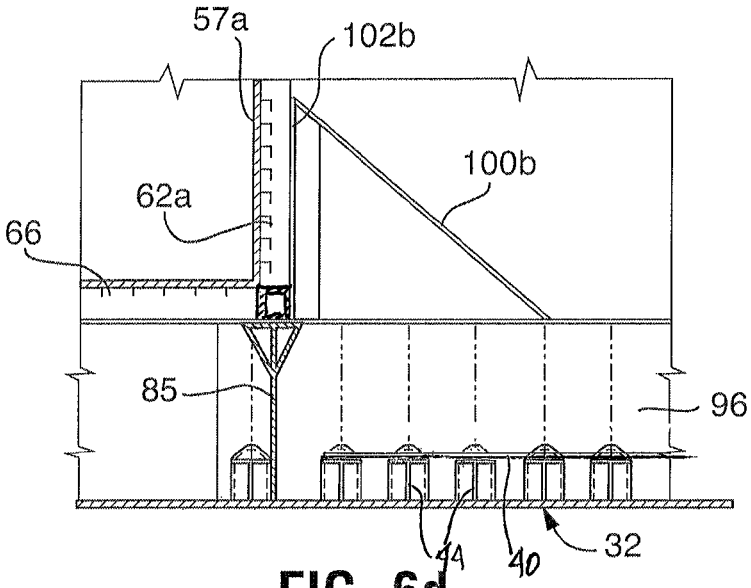
FIG. 6*d* is a magnified view of area T of FIG. 6*a;*

The reinforcements can be formed to provide suitable strength characteristics. For example, reinforcement ribs 44 may be T-shaped in cross section. Thus, a reinforcement rib may have a main upright wall 44*a* and T-flanges 44*b* extending from the main upright wall. The main upright wall is installed substantially orthogonally relative to the plane of plating 31, or a tangent to the plane of the plating where plating is curved (See FIG. 6*b*). Stated another way, the T form is substantially symmetrical about the main upright wall considering the plane of plating 31 at the base of main upright wall and the angle at which T-flanges extend from the main upright wall. This symmetry corresponds to the symmetry about the usual plane of application of force against the hull. These ribs 44 may be formed of high strength, high ductile steel and perform well after their elastic capacity has been exceeded. Flat bar straps 40 connect, as by welding, over the T-shaped ends of a plurality of ribs 44 to hold the ribs stable (See FIG. 6*b*).

Stringers 76 and web frames can also have reinforcing extensions 77 connected thereto. These extensions strengthen the stringers and the web frames.

The longitudinals 44, 76 criss-cross and intersect with web frames 70, 90, 110. For example, the web frames intersect with the longitudinals and may have connections thereto or cutouts to accommodate the passage of the longitudinals through the web frames or vice versa. Web 70, for example, may have a plurality of cutouts 72 at the outer lengthwise edge, each cutout for permitting passage therethrough of a rib 44. A collar 74 may be applied at each cutout to close the space between the web frame and the rib. Collars 74 provide a rigid connection between web 70 and ribs 44 for structural strength and a fluid tight closure for the spaces left by penetrations such as cutouts 72. Collars 74 may, for example, be welded to the web frame and the ribs over the cutouts.

The bottom structure 32 also includes a plurality of criss-crossing reinforcements and a shell plating 31 connected externally of the reinforcements. Shell plating 31 extends in a continuous manner with the shell on the side structures.

The reinforcements of the bottom structure may include, for example, longitudinals such as one or more longitudinal girders 84 and ribs 44. The bottom structure also includes transverse reinforcements such as transverse girders 80, 96, 116. The ribs 44, collaring 74, straps 40 are as described above with respect to side structure. The criss-crossing reinforcements are connected as noted above, for example, transverse girders of the bottom structure are connected to the ribs of the bottom structure in the same way as the side shell web connection to the ribs of the side structure. More specifically, transverse girders have cutouts on a lengthwise edge and collars are welded between the ribs and the girders of the bottom structure. Unless the girder is intended to provide a fluid tight structure, the girders may have one or more holes 83 along their lengths.

The deck structure is similar to the bottom structure and also includes reinforcements such as longitudinal girders, ribs 44 and deck transverse girders 86, 106, 118. Transverse girders of the deck structure may be connected to the longitudinal girders and the ribs of the deck structure in a similar way as the side shell webs connect to the longitudinal reinforcements of the side structures.

Girders 86, 106, 118 and girders 80, 96, 116 are aligned with and connected to, i.e. formed integrally with, web frames 70, 90, 110 on the side structures. As such, the combinations of bottom and deck transverse girders and side web frames each form a continuous structure encircling the hull at their location. The continuous structure of the combinations of bottom and deck transverse girders and side web frames are substantially orthogonal relative to, and spaced apart along, the long axis x of the hull. In addition, a stack 124 of the containers fills the space between some of the continuous structures formed by the girders and web frames to form middle transverse bulkheads.

Figure 4:
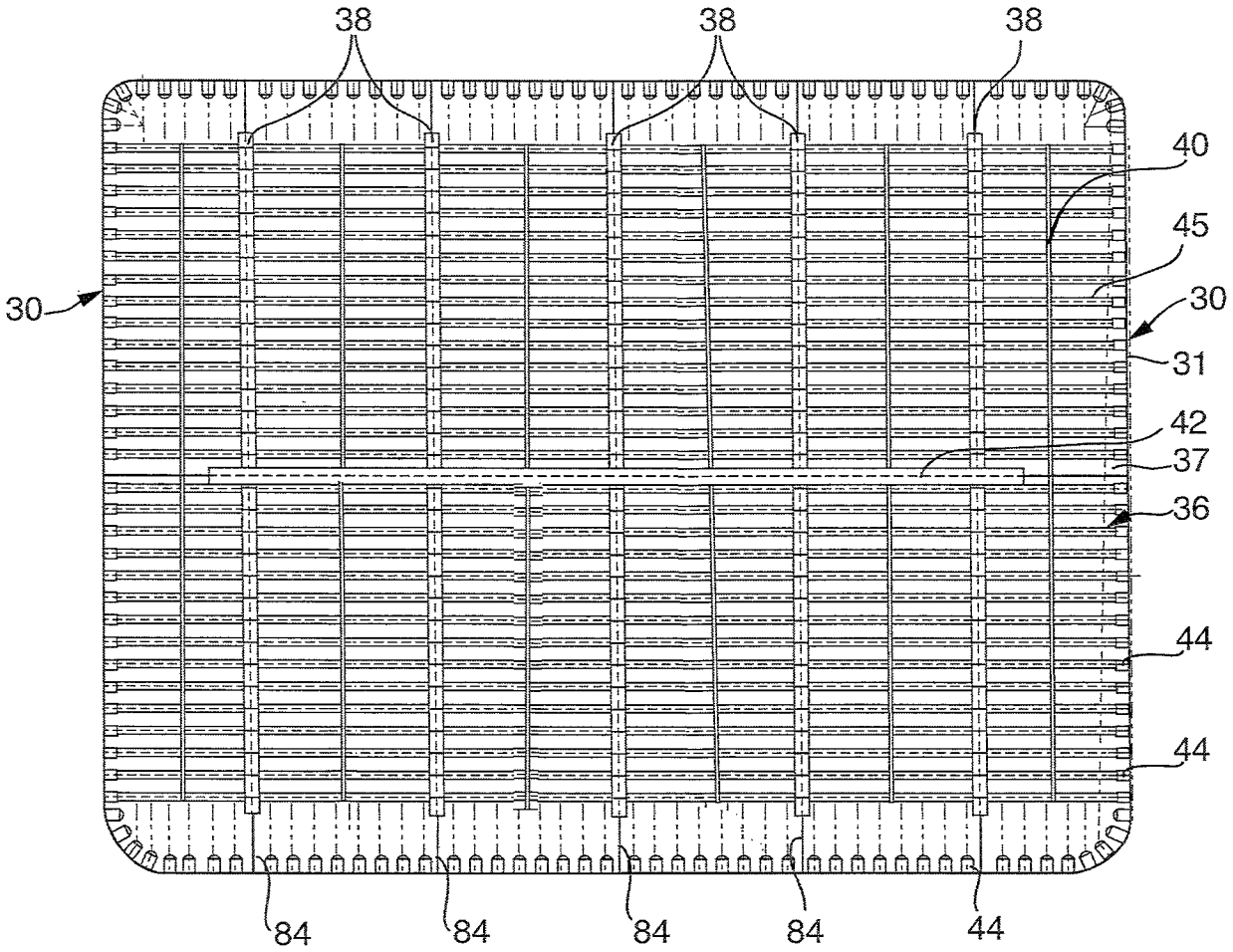
FIG. 4 is a section view along line C-C of FIG. 3.
Figure 5B:
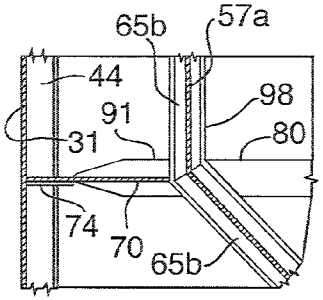
FIG. 5*b* is a section view along line D'-D' of FIG. 5*a;*
Figure 5A:
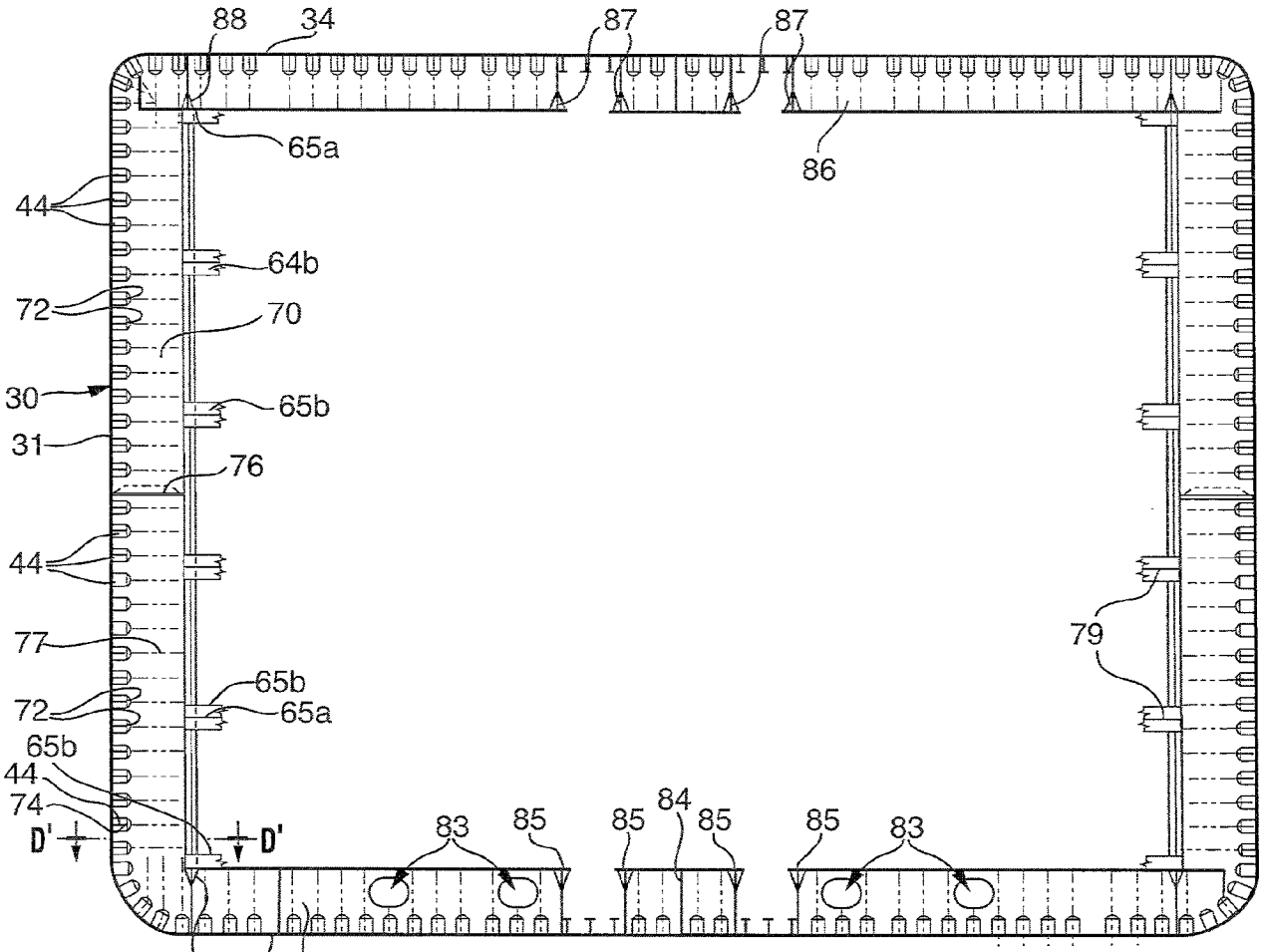
FIG. 5*a* is a section view along line D-D of FIG. 3.

Referring to FIG. 4, the end bulkhead structures 36 are fluid tight and define the ends of the hold. Structures 36 extend laterally, substantially orthogonally, of long axis x with side edges connected to the side structures 30 of the ship, an upper edge connected to the deck structure and a lower edge connected to the bottom structure. Structures 36 each include a plate 37 extending the full area with a number of reinforcements for the plate. For example, the hold-facing side of an end bulkhead structure 36 is shown with vertical girders 38, a flat bar strap 40 between each pair of vertical girders, a horizontal girder 42, and a plurality of horizontal ribs 45. The ribs 45 extend substantially perpendicularly to the girders 38, from one side of end structure 36 to the other, and are positioned intermittently, spaced apart along the length of the girders. The ribs 45 are each T-shaped in cross section when viewed from one end thereof. The T-shape is symmetrical about its main wall between plate 37 and the T extensions. The flat bar straps 40 also connect over the T-shaped ends of a plurality of ribs to hold the ribs stable. The horizontal girder 42 extends substantially perpendicularly across the girders 38, at about mid-length of the girders.

Ribs 44 of side structures 30 pass through plate 37, as the ship's side structures extend beyond the structures 36 to the bow and stern of the ship. While plate 37 may have cut outs where ribs 44 pass through, the cut outs are filled by collars between the ribs and plate 37 to ensure that the end bulkheads 36 are fluid tight and to increase the strength of these structures.

While other bulkheads are formed by stacks of containers, a stack of containers is not generally useful for end bulkheads 36, to ensure that any gas leaks are contained in the hold between bulkheads 36. End bulkheads are formed to be particularly strong, for example comparable to the strength of the hull so that gas even at significant pressures can be contained. The end bulkheads can be formed of high strength, high ductility steel such as EH36.

As noted, gas storage containers 24 are integrated to the ship's hull to form bulkheads and to strengthen the ship overall. Thus, the gas storage containers are not cargo, but are permanently fixed in the ship and an integral part of the ship's construction. The storage containers 24 both contain the gas, which is the cargo, for transport thereof and form the middle transverse bulkheads in the ship. No traditional middle transverse bulkheads are needed.

The gas storage containers are installed as stacks 124 with their flat side surfaces and holes 50 aligned vertically within the hold. Thus, the containers are stably positioned on bottom structure 32. The bottom ring beam 65*b* and the bottom radial beams 66 of the lowest container 24' in the stack may therefore be supported on the bottom structure. Even before integration of the stack into the hull, the stack is quite resistant to tipping and shifting.

Each stack 124 may be connected to a plurality of adjacent structures to further stabilize them and to act with other hull structures to provide structural strength to the ship. For example, each stack 124 is connected transversely at least across the hold between side structures 30 and, as such, each stack becomes integrated to form a middle transverse bulkheads. In smaller ships, each stack may be connected directly to each of the two side structures, the connections being made at substantially diametrically opposed positions on the stack. In larger ships, more than one stack may be accommodated side by side between side structures 30. In such a larger ship, stacks 124 that are positioned adjacent a side structure may be connected directly to that side structure, while there additionally there are stack to stack connections across the middle transverse bulkhead.

Stacks 124 which have a prismatic external shape may be positioned such that structural connections for integration to the ship are made at the flat side surfaces of the stack. A stack's flat side surface may be positioned to extend substantially parallel to a side structure 30, an end bulkhead 36 or an adjacent stack and there may be several connections between each flat side surfaces and the adjacent hull structure.

In addition, each stack 124 may be connected to bottom structure 32 and deck structure 34.

Longitudinal bulkheads are formed by stack-to-stack connections, connections of the endmost stacks to the end bulkheads 36 and connections of the stacks to bottom structure 32 and deck structure 34.

The connections may include reinforcement brackets and connections to counteract torque.

Structures 30, 32, 34 and/or 36 may be shaped on the inner facing sides to accommodate and fit around the stacks.

The connections between structures 30, 32, 34 and stacks 124 may be fluid tight such that the transverse bulkhead that is formed is fluid tight. A fluid tight connection extends fully about each stack that is integrated to construct a transverse bulkhead. In particular, the fluid tight connection extends along both sides, across the bottom and across the top of each stack. The fluid tight connections may create cells in the hold that contain both water leaks and gas leaks, if any should occur.

Referring to FIGS. 2, 3, 5*a*, 5*b*, 6*a* to 6*d*, and 7, a configuration for connecting a side wall of a stack of containers 24 to the ship's side structure 30 is shown. A flat side of a stack of containers may be positioned adjacent and substantially parallel with side structure 30. This provides an expansive area of the stack that can be connected to the side structure such that, if desired, a number of connections may be made between side structure 30 and each stack.

For example, each stack may be connected to a plurality of vertical reinforcements, such as web frames 70, 90, along the side structure. A flat side of the stack may be connected to a plurality of web frames 70, 90 along the side structure.

For example, one of the connection points between a stack of containers 24 and the side structure 30 may be at a corner between two flat sides. The corners are aligned through all the containers in the stack and those corners, in particular the ring beams 65*a*, 65*b* at the corners, may be connected to the web frame 70 as by welding. In one embodiment, web frame 70 is reinforced to withstand the torque and stress of connection to the containers. For example, brackets 91 may be attached to side web frame 70 to reinforce the connection between the web frame and the ring beams.

Referring to FIGS. 2, 3, 5*a*, 5*b*, 6*a* to 6*d*, and 7, the stack of containers 24 may further be connected to the side structures 30 at about the side-to-side midpoint of side walls 56*c*, 56*g* in plan view. In the illustrated embodiment, side wall 56*c* at column 63*a* is connected to web frame 90 as by welding. Again, reinforcements may be added at the connection between web frame 90 and the stack to better withstand stresses. In one embodiment, for example, brackets 92*a* and Y-brackets 92*b* are connected to web frame 90 to reinforce the connection with column 63*a*.

At least one of the connections between side structure 30 and the stack is fluid tight. For example, in this illustrated embodiment, the connection between the side shell web 90 and the side 56*c* of the containers is preferably fluid tight. The connection is made by welding between web 90 and column 63*a* continuously along the entire height of the stack 124. The connections between side shell web 90 and ribs 44 and plating 31 are also fluid tight, such that connection between the stack and the side structure is entirely sealed and fluid tight at that location.

Each stack 124 of containers is supported on bottom structure 32 and may be connected rigidly and in a fluid tight manner to bottom structure 32. The bottom structure may include brackets, reinforcements, etc. to provide adequate support for the stack and to accommodate stresses. In addition, the bottom structure may include members that extend to provide a fluid tight seal under the stack to complete the transverse bulkhead.

Some girders are formed to accept connection, such as a welded connection to the lowermost container. In addition, bottom structure 32 may include reinforcements such as supports 85, 98 specifically integrated to add additional support and possibly provide for rigid connection or the fluid tight seal in the formation of the transverse or longitudinal bulkheads. Reinforcements may, for example, be point supports or elongate members such as brackets, reinforced girders or torque supports such as a Y girder.

In the illustrated embodiment, supports 85 and 98 are positioned under each stack. In each stack, the radial beams 66 of the lowermost container are supported at their inner ends by support 85 and their outer ends by support structures 98. Supports 85, 98 have a shape and size to follow ring beams 64*b*, 65*b*.

Each support 85 is installed in the bottom structure with a shape, size and position to align under the inner ring beam 64*b* of each container's center core.

Each support structure 98 is an elongate member positioned to align under and support the outer perimeter of the stack of containers 24. The lower side of ring beam 65*b* in the lowermost container of each stack is positioned in alignment over and is supported by and connected to a support structure 98. Support structure 98 has a shape and size in plan view to follow the octagonal shape of the outer ring beam 65*b*. Support structures 98 in particular, are formed of T- and/or Y-girders. As will be appreciated, a girder is an elongate beam having a web and a flanged edge and in the present girder the flanged edge is T-shaped and/or Y-shaped in section. In the illustrated embodiment, the girder is a Y-girder with a T-shaped edge and includes angles between the web and the T flanges that form a Y in section. Support structure 98 extends to follow the octagonal shape of the outer ring beam 65*b*. Support structure 98 extends fully beneath the perimeter of the base 52 of the lowermost container in each stack. Support structure 98 may be, for example, a Y-girder that is laid out in a continuous octagon integrated into bottom structure 32, it being sized to be the same size octagon as the ring beam 65*b* of the container which is to be supported on it. Support structures 98 each also have a flat upper surface that may be wider than the width of the material forming ring beam. Ring beams 65*b* may therefore be secured to, as by welding, and fully supported on the support structures 98.

The connection from the lowermost container in each stack, through support structure 98 and to plating 31 of the bottom structure is entirely fluid tight about the entire perimeter of the stack.

Support structures 85, 98 intersect transverse girders 80, 96 and longitudinal girders 84.

Transverse girders 80, 96 also support and have connections to the stack positioned thereon. For example, girder 80 is formed (FIG. 5*a*) for accommodating connection to the lowermost container, including connections to the ring beams 64*b*, 65*b* of the lowermost container 24. Girder 80 specifically supports a corner of the stack of containers (see top plan view in FIG. 5*b*) under the outer ring beam.

FIG. 6*a* shows another transverse girder 96 of bottom structure 32 on which a stack is supported. As noted, transverse girder 96 aligns with web frame 90. In this embodiment, transverse girder 96 supports stack 124 centered thereover. Girder 96 supports the stack of containers at various points under the base 52 of the lowermost container, between sides 56*c* and 56*g*. In the illustrated embodiment, radial beam 66 connecting column 63*a* to directly opposite inner column 62*a* is supported by girder 96.

Connections between the ship structure and each stack also may further include brackets between bottom structure 32 and the hole of the stack. As shown, for example, there may be at least a pair of transversely extending opposing brackets 100*b* connected between girder 96 and the inner wall defining hole 50. Each bracket 100*b* may include a vertical mounting plate 102*b* at an outer end. The distance between mounting plates 102*b* is substantially the same or smaller than the inner diameter across hole 50 of the core of the lowermost container, such that the brackets are installed inside the lower end of the core. The vertical plates may be connected to a diametrically opposed pair of columns 62*a*. Y-brackets may be included to reinforce the connection between the bracket 100*b* and the vertical mounting plate 102*b*.

Longitudinal girders 84 also support and have connections to the stacks that are positioned thereon.

The deck-to-stack connections are also adequate to operate in the transverse bulkhead. The upper ring beam 65*a* of the uppermost container in each stack is positioned below, and in this embodiment is directly in contact with, and connected to, deck structure 34, for example, against a deck transverse girder 86 and the longitudinal girders of the deck structure 34.

The upper side of uppermost ring beam 65*a* in the stack, where it connects to column 63, abuts against support structure 88. The uppermost inner ring beam 64*a* is secured to supports 87 for reinforcement. Supports 87 and structure 88 may be Y-girders similar to that described above in respect of structures 98.

The connection from the uppermost container in each stack, through support structure 88 and to plating 31 of the deck structure is entirely fluid tight about the entire perimeter of the stack.

The radial beam 67 extending between columns 62*a* and 63*a* of the uppermost container in the stack abuts against a deck transverse girder 106 of the deck structure 34. The ends of the radial beam 67 of the uppermost container also are aligned under and are contacted by support structures 87, 88 in the deck structure 34.

Girder 106 further includes a pair of transversely extending opposing brackets 100*a*, each with a vertical mounting plate 102*a* at an outer end. The distance between vertical plates 102*a* is substantially the same or smaller than the inner diameter of the hole 50 of the uppermost container 24. As such, brackets 100*a* can fit inside the core of the uppermost container. Preferably, when the brackets 100*a* and vertical plates 102*a* are fitted inside the core, the vertical plates abut against and can be connected to the inner wall of the core. Y-brackets may be included to stabilize the connection between the bracket 100*a* and the vertical mounting plate 102*a*.

Figure 7:
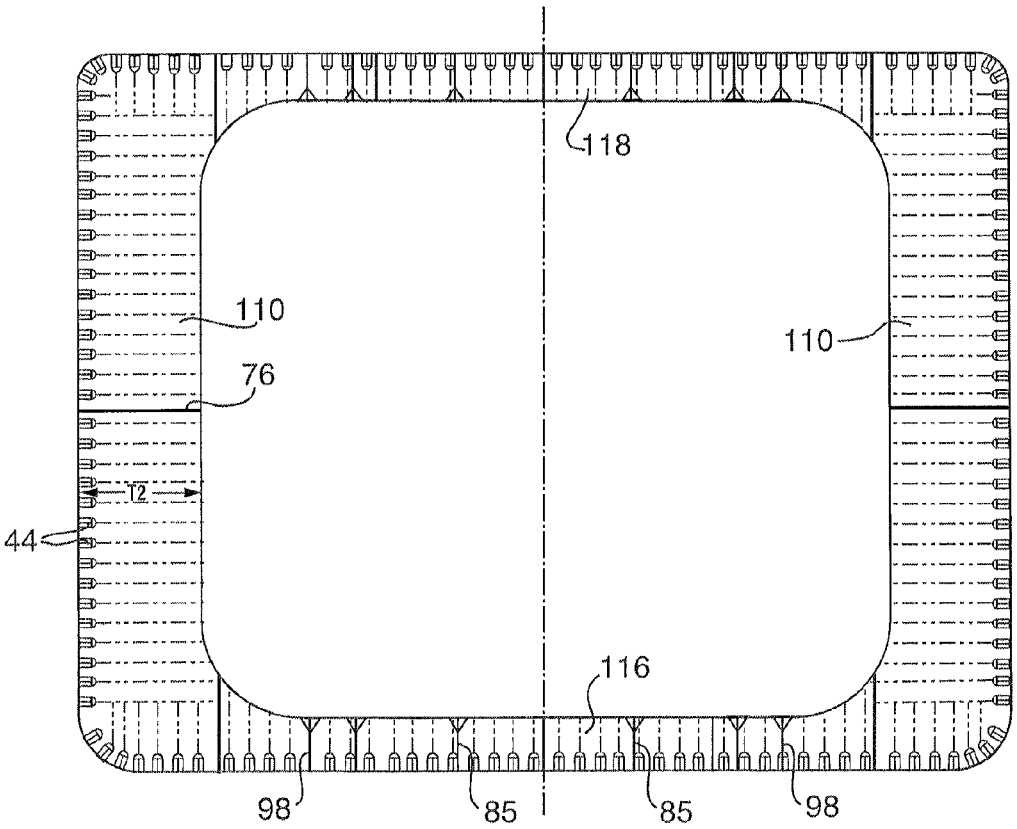
FIG. 7 is a section view along line F-F of FIG. 3.

In FIG. 7, another section is shown through the hull with a portion extending through a container mounting area. Please note that containers 24 are omitted in FIG. 7. Frame web 110 and transverse girders 116 and 118 extend transversely across the hull at this axial location along the hull. Structures 98 extend here as well and intersect girder 116 in this section to continue to support the outer perimeter of the stack of containers 24. In addition, structures 88 extend and intersect girder 118 in this section to provide a wall following the outer perimeter of the stack of containers 24.

Figure 8:
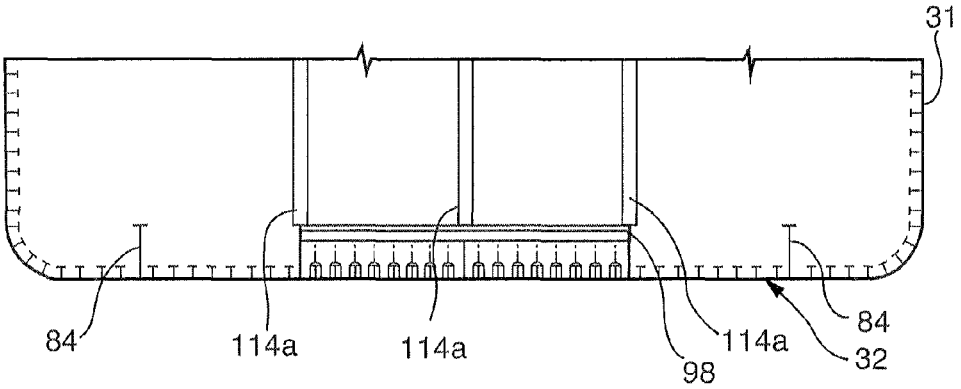
FIG. 8 is a section view along line G-G of FIG. 3.
Figure 9:
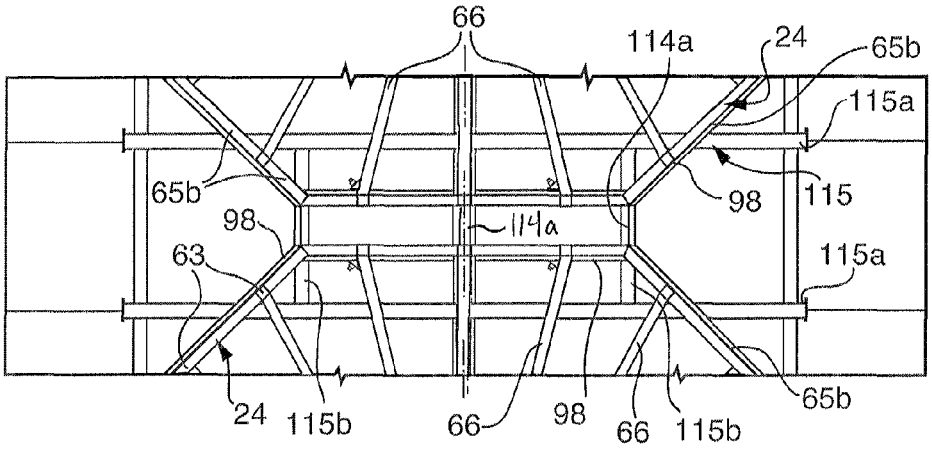
FIG. 9 is a plan view of an area between adjacent containers.

As noted, the stacks of containers may be connected together to form a transverse bulkhead (FIG. 10). However, stacks 124 may also be connected longitudinally along the length of the hull substantially parallel to axis x to form longitudinal bulkheads. The stacks may be directly connected together if they touch or brackets 114 may be employed to connect between adjacent stacks. With reference also to FIGS. 8 and 9, brackets 114 may have vertical members 114*a* and horizontal members that provide a rigid box connection between the stacks. Brackets 114 may be reinforced to increase their strength. Brackets 114 may be installed by welding or bolting, but provide a number of possible connection locations across the adjacent flat sides of the stacks 124.

Although not shown, brackets such as brackets 114 may be employed to form the connections between adjacent stacks of containers where a transverse bulkhead is formed by more than one stack. Brackets 114, where they are employed to connect stacks side by side in a transverse bulkhead may be fluid tight, including a solid web between the stacks secured by a durable and fluid tight seal, as by welding. Alternately, the containers may be connected together directly if they come into contact.

A base 115 may be installed on bottom structure 32, such as on longitudinal and transverse reinforcements thereof, to provide support for the brackets 114 and the ends such as ring beams 65*b* and radial beams 66 of the connected containers. Base 115 may include transverse members 115*a* and longitudinal members 115*b*. Support structures 98 also extend through base 115 as they follow the perimeter shape of a container, such as the shape of ring beam 65*b*.

Each end transverse bulkhead 36 can act as an anchoring point for any containers 24 adjacent thereto. A stack of containers may be connected at contact points of girders 37, 38 in a manner similar to that described above with respect to web frame 70 and 90 or with brackets may be employed, for example, similar to brackets 114, as also described above.

Thus, the stacks 124 are integrated into the hull and form transverse bulkheads axially spaced between the two end transverse bulkheads 36. The connections described above between stacks 124 and side structures 30, bottom structure 32 and deck structure 34 provide the ship with structural rigidity. However, the middle transverse bulkheads, formed by the integration of the stacks into the ship, also provide fluid tight seal to form contained compartments. The fluid tight seal may be impervious to leakage of water and of gas, such as the gas to be transported or an inert gas for safety.

The fluid tight seal is formed in part by the stacks. For example, as noted, the enclosure for each container is fluid tight and, as well, the containers are connected together such that all interfaces between containers are sealed by seals 79. Thus, the stack presents a fluid tight wall. In addition, the connections between the stack and the side structures 30, bottom structure 32 and deck structure 34 all can include some portion that is sealed to be fluid tight. For example, the web 90 may be solid (i.e. without holes) and its connections to ribs 44, stringers 76, plating 31, etc. may be fluid tight. In addition, the connections between each web 90 and each stack 124 may be fluid tight, as by welding along the entire interfacing edge of web 90 and column 63*a*.

To form the fluid tight seal over and under the stack, transverse girders such as girders 96 and 106 can be solid to stop fluid passage. Alternately, as shown in the illustrated embodiment, a fluid tight seal may be installed in bottom structure 32 and deck structure 34 that follows the perimeter of each stack. In particular, support structures 88, 98 may be formed solid, may be installed to have the same shape as the outer shape of the stack (in plan view) and a seal is installed, as by welding or otherwise filling, at the entire adjacent surfaces between stack and structures 88, 98. For example, referring directly to support structure 98, its web portion may be formed solid (i.e. without holes) and its intersections with ribs 44, beams 84, girders 115*a*, plating 31, etc. may be fluid tight. Further, support structure 98 may be installed to have the same shape as that of lower ring beam 65*b* (in plan view) and the connections may be fluid tight between support structure 98 and lower ring beam 65*b* of the lowermost container in the stack.

In summary, each middle transverse bulkhead is formed of the integrally connected combination of (i) one or more stacks 124 of gas storage containers 24 (ii) side structures 30, (iii) bottom structure 32 and (iv) deck structure 34, wherein each one or more stacks are integrally connected to one or both side structures 30, bottom structure 32 and deck structure 34. If there is more than one stack in the transverse bulkhead, the adjacent stacks are integrally connected together at a side-by-side connection and the side stacks are connected to the side structure to which they are most adjacent at a point substantially diametrically opposite the side-by-side connection. The integrally connected combination extends transversely across the hull, substantially orthogonally relative to the long axis x.

Bulkheads provide structural stability and rigidity to the ships. They also minimize the violent sheer forces acting on the ship, that are generated due to waves. The combination configured as the transverse bulkhead together absorbs stresses acting on the ship and provide structural stability and rigidity. For example, the combination bends together in response to forces to cause bending, however slight, of the ship. The integral connections between the stacks, side structures 30, bottom structure 32 and deck structure 34 must rigid and very durable to permit operation in the bulkhead. As such, a durably welded connection is most appropriate.

Bulkheads may also prevent water infiltration to all parts of the ship in case of flooding. In this case, in a ship for transport of cargo gas, in the unlikely event of a leak, the bulkheads may also prevent infiltration of leaked gas throughout the ship. As such, the middle transverse bulkhead, which is an integrally connected combination of (i) one or more stacks 124 of gas storage containers 24 (ii) side structures 30, (iii) bottom structure 32 and (iv) deck structure 34, may also be configured to form a fluid seal against passage of fluid, including water and leaked gas, from one side of the bulkhead to the other. In one embodiment, complete welding may be employed to create the fluid tight seal that extends all the way around between the stack and each of the (ii) side structures 30, (iii) bottom structure 32, (iv) deck structure 34 and/or (v) an adjacent stack, to which the stack is connected. Fluid tight seals may also be present in the container to container connections within each stack. Again welding may be employed to, for example, weld the lower outer ring beam of each container to the upper outer ring beam of the container on which it is stacked. The weld may be continuous about the entire perimeter of the ring beams so that the weld provides not only a durable connection but a complete fluid tight seal.

With reference to FIG. 3, in the illustrated embodiment, each middle transverse bulkhead is the full integrally connected combination of side structure 30, including web frames 70, 90, and the enclosure wall 56*g* of each of the containers 24 in a stack, the entire container enclosure between walls 56*h*, 56*a*, 56*b* on one side and walls 56*f*, 56*e*, 56*d* on the opposite side and the connections between web frames 70, 90 and the enclosure wall 56*c* of each of the containers 24 in a stack. In addition with reference to FIG. 6*a*, each middle transverse bulkhead further includes the full integrally connected combination including bottom structure 32, including longitudinal and transverse girders and support structures 85, 98, supporting and connected to the enclosure of the lowermost container 24", all the container enclosures in the stack, which are each connected to adjacent containers above and below in the stack, and deck structure 34, including longitudinal and transverse girders and support structures 87, 88 above and connected to the enclosure of the uppermost container.

The fluid tight seal of the transverse bulkhead is configured by the seals between all the containers in the stack and web frames 90 on both sides, support structure 98, support structure 88, and the seals between all these parts. If there are two or more stack extending transversely side by side within the ship, the fluid tight seal will also include the stack to stack connection.

As it will be appreciated then, the cargo-gas-carrying pipes 25, that are contained within each enclosure of each container, are installed within the middle transverse bulkheads. The cargo gas storage pipe is coiled in plural layers of plural loops within the enclosures. However, the pipes 25 are free of integral connections into the structure of the middle transverse bulkheads. The walls of pipe 25 are not structurally connected into the transverse bulkhead, but rather contained within enclosures.

Figure 12:
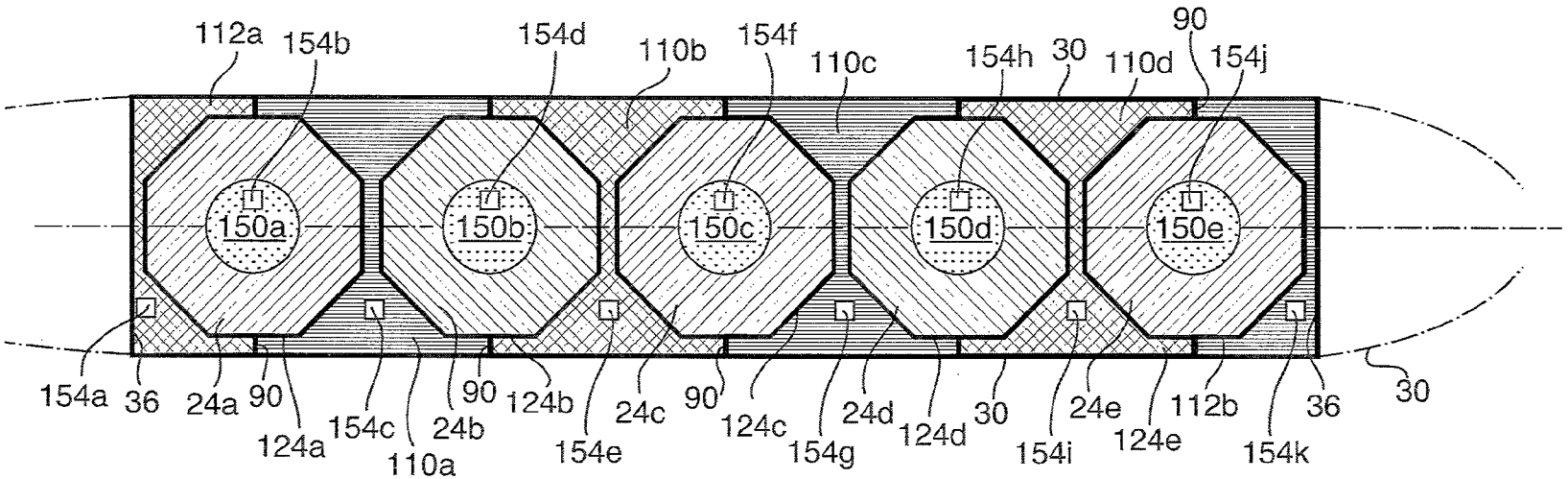
FIG. 12 is a schematic top plan view of a ship with a hold divided into fluid tight compartments.

The transverse bulkheads formed by stacks 124, therefore, form fluid tight compartments that may be impervious to water as well as gas. Since gas, such as CNG, is stored and transported by the ship, the fluid tight seals can contain gas leaks, if any, and may permit the compartments between bulkheads to be filled with inert gas. FIG. 12 shows the compartments 110*a*, 110, 110*c*, 110*d* formed between the bulkheads formed by stacks 124*a* to 124*e* as well as the compartments 150*a* to 150*e* formed within each stack. Two compartments 112*a*, 112*b* are also formed at the ends: one between each of the first and last stacks 124*a*, 124*e* their adjacent end transverse bulkhead 36. The enclosure of each container in each stack is also fluid tight as shown by compartments 24*a* to 24*e*.

By formation of the bottom and the top fluid tight seals 88, 98 about the perimeter of the base of the stacks, compartments 150*a* to 150*e* are open to the most surface area of the containers in each stack including below and above each of them. As such, this formation of the seals through support structures 88, 98 ensures that the most gas leaks, if they occur, are contained in these compartments 150*a* to 150*e* and vented via vent lines and vent stack 69.

At the top of each compartment, built into the deck structure, is a relief hatch 154*a* to 154*k*. The relief hatch for the compartment is selected to open if major over pressure condition occurs in any of the compartments. In one embodiment, the gas is stored in the pipes 25 in the containers is at about a maximum of 4000 psi and the relief hatches are selected to open at an internal pressure of 25 psi. The hold 22 created by structures 30, 32, 34 and end bulkhead structures 36 has a pressure holding capacity of about 100 psi. The vents and relief hatches 154*a*-154*k* therefore alleviate any concern over a leak from a container, as the pressure will be relieved venting and, if necessary, by hatches and the gas will be removed from the hull.

The inert gas in the compartments is maintained at pressures below 1 psi.

The remainder of hull 21 apart from hold 22 may be constructed to have a lower pressure holding capacity, for example 75% or less than the pressure holding capacity of hold 22.

While the side, bottom and deck structures provide numerous connection points to integrate the gas storage containers into the ship, these structures may also further be shaped to partially surround and thereby stabilize of the stacks 124 to prevent lateral or longitudinal movement thereof. For example, the spacing between the two opposite side structures 30 provides a close fit of the stacks of containers 24 therebetween. Alternately or in addition, the side structures may be shaped to protrude into void spaces between adjacent stacks 124 in the longitudinal direction. For example, the side structure 30 at stacks 124 may have a depth T1 that is less than the side structure depth T2 at the void spaces. As such, the depth of side structures 30 may vary to be less deep T1 in certain areas, providing a space within the hull to accommodate the stacks 124 in those locations, but to be thicker T2 in other areas, to protrude inwardly to accommodate some of the space between longitudinally adjacent containers 24. The greater wall depth at area T2 creates an inwardly extending protrusion, such as at web frame 110, which may block, and therefore prevent, longitudinal shifting of the stacks. This protrusion at T2 also provides greater strength for side structure 30 in the locations where the side structure is not supported by a stack of containers. The less deep T1 areas are aligned across axis x between the two side structures so that the containers are accommodated between aligned thinner wall areas.

To further appreciate the varying depth of side structures 30, consider the horizontal depth of stringer 76 between its outer edge surface to which plating 31 is connected and inner edge (i.e. where containers are connected). Referring to FIGS. 3, 5*a*, 6*a* and 7, stringer 76 is deeper T1 in certain areas such as at the location of web frame 110 along the length of the hull. In other areas, stringer 76 is less deep T2 such as at the location of web frames 70 and 90. The stringers 76 that extend along the axial length of sides 30 may be scalloped to transition between the deeper and less deep areas. The deeper area protrudes into spaces 22 between longitudinally adjacent containers, while the less deep areas accommodate the containers thereagainst.

Stringer 76 and web frames, for example, web frame 110 are deeper at various locations along the axis x where the side structure is not directly connected to a side of a stack of containers 24. This increased depth T2 (i.e. the distance between the inner edge of stringer 76 and the sheet plating 31) creates a protrusion that accommodates some of the space 22 between containers, preventing the containers from moving and keeping the containers separated and in place. The increased wall depth may help to reinforce areas of the hold structure that are open and not reinforced by containers.

Figure 11:
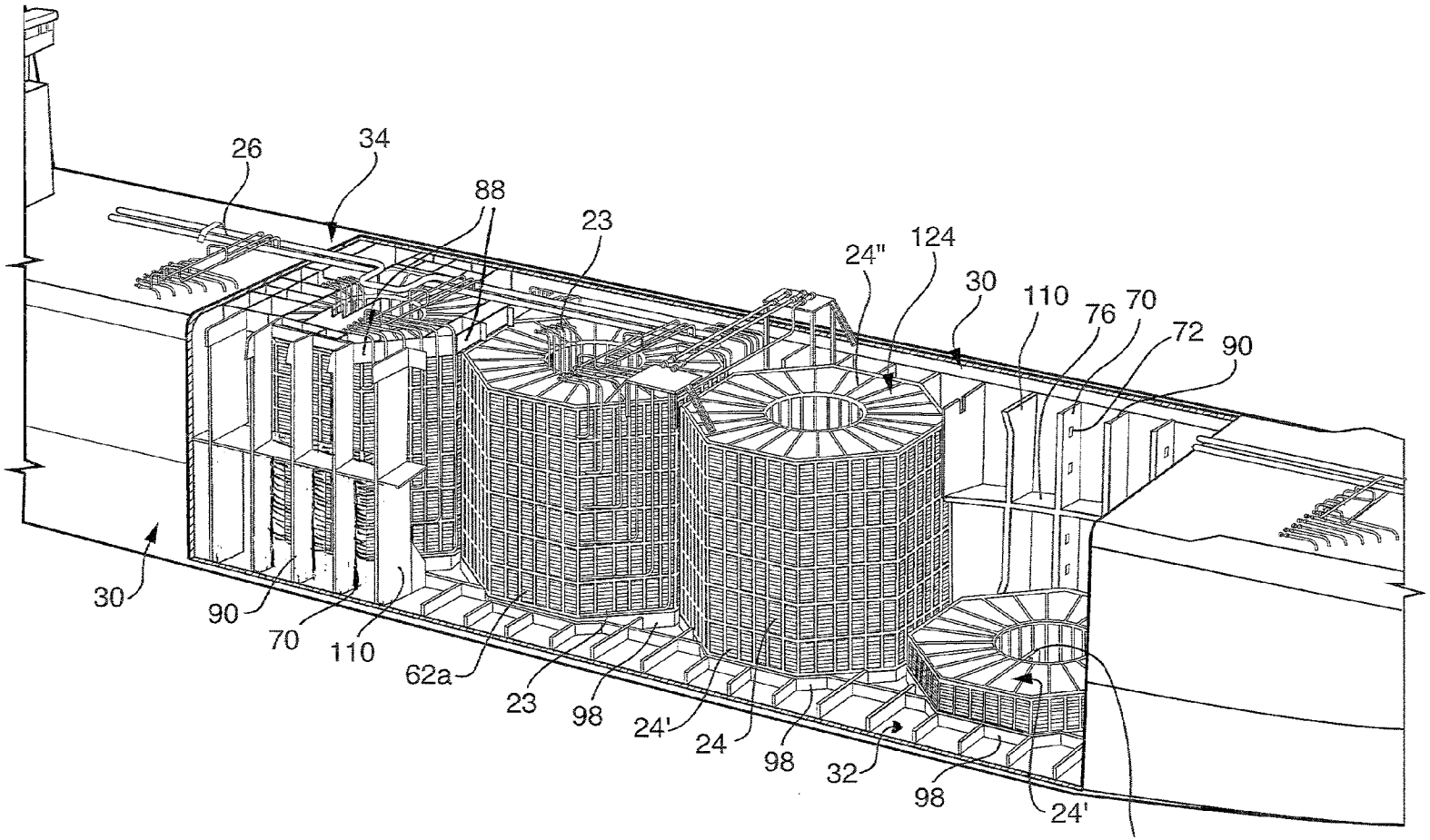
FIG. 11 is a perspective view, partly cut away, showing a ship during construction.

With reference to FIG. 11, a ship under construction is shown, showing lower support structures 98, which form the fluid tight bottom seals for the middle transverse bulkheads, installed in the bottom of the hull. Structures 98 follow the outer perimeter shape of the containers 24 to be stacked thereon.

The lowermost container 24' in each stack is installed in a fluid tight manner on its support structure 98. As noted, this may include welding lower ring beam 65*b* to support structure 98 about the entire perimeter of the container.

A further container is then brought in, lowered into position and installed on the lowermost container 24' and further containers are installed thereon. Each container is sealed, as by welding, to the container therebelow to form the fluid tight exterior walls of each stack.

Rigid, durable connections are present between side structures 30 and stack 124. For example, connections are present between some and perhaps all the web frames 70, 90, 110 that are adjacent the flat side of the stack 124. At least one connection between the side structure and the stack, such as the connection between web frame 90 and stack 124, is fluid tight along the full height from top to bottom and this fluid tight connection is connected via a fluid tight connection to bottom structure 98.

If the flat side of a stack is adjacent another stack, instead of a side structure of the hull, then a rigid, durable and fluid tight connection is made between the stacks.

Upper support structure 88 is rigidly and durably connected between deck structure 34 and the uppermost container 24" in each stack. Upper support structure 88 also completes the fluid tight seal for each middle transverse bulkhead formed by a stack 124. Each support structure 88 follows the outer perimeter shape of the outer ring beam 65*a* of uppermost container 24" against which the support structure is to seal.

As such, each transverse bulkhead in the ship includes at least one stack of containers 24 and rigid, durable and fluid tight connections between the at least one stack of containers and the side structures, the bottom structure and the deck structure. In particular, the connections encircle the stack, extending continuously along the bottom, the sides and the top of each stack in the at least one stack of containers. The containers in the stacks each include an enclosure enclosing a coil of pipe in which the cargo gas is transported. The connections are specifically made between the enclosures of the containers whatever parts of the side structures, the bottom structure and the deck structure that is adjacent to the enclosure of each container. The rigid, durable and fluid tight connection between the enclosure of the lowermost container in the stack and the bottom structure of the ship follows the outer perimeter shape of the enclosure of the lowermost container.

A longitudinal bulkhead includes at least one stack of containers, frames 114 between stacks 124 for connecting the adjacent stacks together and frames 114 connecting the end most stacks to the end bulkhead structures 36.

Any transportable gas may be transported with the ship structure of the invention, such as natural gas. The transport of compressed natural gas (CNG) at ambient temperatures is of particular interest.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A ship for transporting gas comprising:

a ship structure including a hull including a port side structure, a starboard side structure, a deck structure and a bottom structure; a forward end bulkhead; and a rear end bulkhead; and a middle transverse bulkhead spaced between the forward end bulkhead and the rear end bulkhead, the middle transverse bulkhead including:

a) at least one stack of gas storage containers, each stack including a lowermost gas storage container and an uppermost gas storage container, each of the uppermost gas storage container and the lowermost gas storage container including a construction including: an enclosure and a cargo gas storage pipe within the enclosure, the cargo gas storage pipe being a substantially continuous pipe coiled in plural layers, each of said plural layers including plural loops of said pipe; and b) connections configured to integrate the at least one stack of gas storage containers into the ship structure including (i) connections between the enclosures of the at least one stack of gas storage containers and each of the port side structure and the starboard side structure, (ii) a connection between the enclosure of the uppermost gas storage container and the deck structure, (iii) a connection between the enclosure of the lowermost gas storage container and the bottom structure, and (iv) a fluid tight seal to prevent passage of fluid across the middle transverse bulkhead and the fluid tight seal extends between adjacent ones of the gas storage containers, wherein the fluid tight seal is installed in the bottom structure and extends about a perimeter of the lowermost gas storage container and wherein at least three fluid tight compartments are formed by the fluid tight seal including: a first compartment on one side of the middle transverse bulkhead, a second compartment on an opposite side of the middle transverse bulkhead and a third compartment within the at least one stack.

2. The ship of claim 1 further comprising a longitudinal bulkhead extending at least from the forward end bulkhead to the rear end bulkhead, the longitudinal bulkhead including:

a) a plurality of stacks of gas storage containers including a selected one of the least one stack of gas storage containers, a rearmost stack and a forwardmost stack, each of the plurality of stacks of gas storage containers including container enclosures, the plurality of stacks of gas storage containers being substantially axially aligned between the forward end bulkhead and the rear end bulkhead; and b) integral connections configured to integrate the plurality of stacks of gas storage containers into the ship structure including (i) series connections between the container enclosures of the plurality of stacks of gas storage containers in series, (ii) upper and lower connections between the container enclosures of the plurality of stacks of gas storage containers and each of the deck structure and the bottom structure, (iii) a rear connection between the container enclosure of the rearmost gas storage container and the rear end bulkhead, and (iv) a forward connection between the container enclosure of the forwardmost gas storage container and the front end bulkhead.

3. The ship of claim 1 wherein the at least three fluid tight compartments each include a relief hatch openable in response to an over pressure condition.

4. The ship of claim 1 wherein the at least three fluid tight compartments are each filled with inert gas.

5. The ship of claim 1 wherein a selected stack of the at least one stack of the gas storage containers includes:

a. a first, flat, exterior, side wall and wherein the first, flat, exterior, side wall is connected to the port side structure by a plurality of axially spaced connections and one of the plurality of axially spaced connections is a fluid tight connection to a fluid tight web frame extending fully between the bottom structure and the deck structure.

6. The ship of claim 5 wherein the selected stack is formed as a polygonal prism with a second flat exterior side wall diametrically opposite the first, flat, exterior, side wall, the second, flat, exterior, side wall is connected to either (a) the starboard side structure or (b) a flat side wall of an adjacent stack of gas storage containers.

7. The ship of claim 6 wherein the stack has a shape defined as an octagonal prism.

8. The ship of claim 1 wherein the port side structure includes a stringer extending longitudinally, the stringer having a reduced depth adjacent the at least one stack of gas storage containers forming the at least one middle transverse bulkhead and the stringer having a greater depth in spaces axially forward of and axially rearward of the middle transverse bulkhead such that the stringer protrudes further into the spaces.

9. The ship of claim 1 wherein the port side structure includes a stringer extending longitudinally thereon, the stringer having an inner edge that is scalloped to form an indented portion of the stringer and the middle transverse bulkhead is integrated into the indented portion of the stringer.

10. The ship of claim 1 wherein the enclosures are filled with and surrounded by an inert gas.

11. The ship of claim 1 wherein the enclosures each include a main support formed as a reel and the pipe is coiled about the reel and wherein the enclosure is substantially fluid tight to define a fluid tight space about the coiled pipe.

12. The ship of claim 1 wherein the side structures each include:

a) a web frame;

b) plating covering an exterior side of the web frame;

c) a plurality of longitudinally extending ribs extending at right angles relative to the web frame, each of the plurality of ribs having a T-shape in cross section including a main upstanding wall and a pair of flanges extending from the main upstanding wall and forming the T-shape relative to the main upstanding wall, each rib being substantially symmetrical about the main upstanding wall relative to the plating;

d) collars sealing any penetrations where the plurality of ribs pass through the web frame; and e) a strap extending over the plurality of ribs and connected to the pair of flanges of each rib; and wherein the deck structure and the bottom structure each include:

f) a transverse girder;

g) plating covering an exterior side of the transverse girder;

h) a plurality of longitudinally extending ribs extending at right angles relative to the transverse girder, each of the plurality of ribs having a T-shape in cross section including a main upstanding wall and a pair of flanges extending from the main upstanding wall and forming the T-shape relative to the main upstanding wall, each rib being positioned to define a substantial symmetry about the main upstanding wall relative to the plating;

i) collars sealing any penetrations where the plurality of ribs pass through the transverse girder; and j) a strap extending over the plurality of ribs and connected to the pair of flanges of each rib.

13. A ship for transporting gas comprising:

a ship structure including a hull including a port side structure, a starboard side structure, a deck structure and a bottom structure; a forward end bulkhead; and a rear end bulkhead; and a middle transverse bulkhead spaced between the forward end bulkhead and the rear end bulkhead, the middle transverse bulkhead including:

a) at least one stack of gas storage containers, each stack including a lowermost gas storage container and an uppermost gas storage container, each of the uppermost gas storage container and the lowermost gas storage container including a construction including: an enclosure and a cargo gas storage pipe within the enclosure, the cargo gas storage pipe being a substantially continuous pipe coiled in plural layers, each of said plural layers including plural loops of said pipe, wherein a selected stack of the at least one stack of the gas storage containers includes a first, flat, exterior, side wall; and b) connections configured to integrate the at least one stack of gas storage containers into the ship structure including (i) connections between the enclosures of the at least one stack of gas storage containers and each of the port side structure and the starboard side structure, (ii) a connection between the enclosure of the uppermost gas storage container and the deck structure, (iii) a connection between the enclosure of the lowermost gas storage container and the bottom structure, and (iv) a plurality of axially spaced connections connecting the first, flat, exterior, side wall to the port side structure and one of the plurality of axially spaced connections is a fluid tight connection to a fluid tight web frame extending fully between the bottom structure and the deck structure.

14. The ship of claim 13 further comprising a longitudinal bulkhead extending at least from the forward end bulkhead to the rear end bulkhead, the longitudinal bulkhead including:

a plurality of stacks of gas storage containers including a selected one of the least one stack of gas storage containers, a rearmost stack and a forwardmost stack, each of the plurality of stacks of gas storage containers including container enclosures, the plurality of stacks of gas storage containers being substantially axially aligned between the forward end bulkhead and the rear end bulkhead; and integral connections configured to integrate the plurality of stacks of gas storage containers into the ship structure including (i) series connections between the container enclosures of the plurality of stacks of gas storage containers in series, (ii) upper and lower connections between the container enclosures of the plurality of stacks of gas storage containers and each of the deck structure and the bottom structure, (iii) a rear connection between the container enclosure of the rearmost gas storage container and the rear end bulkhead, and (iv) a forward connection between the container enclosure of the forwardmost gas storage container and the front end bulkhead.

15. The ship of claim 13 wherein the selected stack is formed as a polygonal prism with a second flat exterior side wall diametrically opposite the first, flat, exterior, side wall, the second, flat, exterior, side wall is connected to either (a) the starboard side structure or (b) a flat side wall of an adjacent stack of gas storage containers.

16. The ship of claim 15 wherein the stack has a shape defined as an octagonal prism.

17. The ship of claim 13 wherein the port side structure includes a stringer extending longitudinally, the stringer having a reduced depth adjacent the at least one stack of gas storage containers forming the at least one middle transverse bulkhead and the stringer having a greater depth in spaces axially forward of and axially rearward of the middle transverse bulkhead such that the stringer protrudes further into the spaces.

18. The ship of claim 13 wherein the port side structure includes a stringer extending longitudinally thereon, the stringer having an inner edge that is scalloped to form an indented portion of the stringer and the middle transverse bulkhead is integrated into the indented portion of the stringer.

19. The ship of claim 13 wherein the enclosures are filled with and surrounded by an inert gas.

20. The ship of claim 13 wherein the enclosures each include a main support formed as a reel and the pipe is coiled about the reel and wherein the enclosure is substantially fluid tight to define a fluid tight space about the coiled pipe.

21. The ship of claim 13 wherein the side structures each include:

a web frame;

plating covering an exterior side of the web frame;

a plurality of longitudinally extending ribs extending at right angles relative to the web frame, each of the plurality of ribs having a T-shape in cross section including a main upstanding wall and a pair of flanges extending from the main upstanding wall and forming the T-shape relative to the main upstanding wall, each rib being substantially symmetrical about the main upstanding wall relative to the plating;

collars sealing any penetrations where the plurality of ribs pass through the web frame; and a strap extending over the plurality of ribs and connected to the pair of flanges of each rib; and wherein the deck structure and the bottom structure each include:

a transverse girder;

plating covering an exterior side of the transverse girder;

a plurality of longitudinally extending ribs extending at right angles relative to the transverse girder, each of the plurality of ribs having a T-shape in cross section including a main upstanding wall and a pair of flanges extending from the main upstanding wall and forming the T-shape relative to the main upstanding wall, each rib being positioned to define a substantial symmetry about the main upstanding wall relative to the plating;

collars sealing any penetrations where the plurality of ribs pass through the transverse girder; and a strap extending over the plurality of ribs and connected to the pair of flanges of each rib.

22. A ship for transporting gas comprising:

a ship structure including a hull including a port side structure, a starboard side structure, a deck structure and a bottom structure; a forward end bulkhead; and a rear end bulkhead; and a middle transverse bulkhead spaced between the forward end bulkhead and the rear end bulkhead, the middle transverse bulkhead including:

a) at least one stack of gas storage containers, each stack including a lowermost gas storage container and an uppermost gas storage container, each of the uppermost gas storage container and the lowermost gas storage container including a construction including: an enclosure and a cargo gas storage pipe within the enclosure, the cargo gas storage pipe being a substantially continuous pipe coiled in plural layers, each of said plural layers including plural loops of said pipe; and b) connections configured to integrate the at least one stack of gas storage containers into the ship structure including (i) connections between the enclosures of the at least one stack of gas storage containers and each of the port side structure and the starboard side structure, (ii) a connection between the enclosure of the uppermost gas storage container and the deck structure, and (iii) a connection between the enclosure of the lowermost gas storage container and the bottom structure, wherein the port side structure includes a stringer extending longitudinally, the stringer having a reduced depth adjacent the at least one stack of gas storage containers forming the at least one middle transverse bulkhead and the stringer having a greater depth in spaces axially forward of and axially rearward of the middle transverse bulkhead such that the stringer protrudes further into the spaces.

23. The ship of claim 22 further comprising a longitudinal bulkhead extending at least from the forward end bulkhead to the rear end bulkhead, the longitudinal bulkhead including:

a plurality of stacks of gas storage containers including a selected one of the least one stack of gas storage containers, a rearmost stack and a forwardmost stack, each of the plurality of stacks of gas storage containers including container enclosures, the plurality of stacks of gas storage containers being substantially axially aligned between the forward end bulkhead and the rear end bulkhead; and integral connections configured to integrate the plurality of stacks of gas storage containers into the ship structure including (i) series connections between the container enclosures of the plurality of stacks of gas storage containers in series, (ii) upper and lower connections between the container enclosures of the plurality of stacks of gas storage containers and each of the deck structure and the bottom structure, (iii) a rear connection between the container enclosure of the rearmost gas storage container and the rear end bulkhead, and (iv) a forward connection between the container enclosure of the forwardmost gas storage container and the front end bulkhead.

24. The ship of claim 22 wherein the enclosures are filled with and surrounded by an inert gas.

25. The ship of claim 22 wherein the enclosures each include a main support formed as a reel and the pipe is coiled about the reel and wherein the enclosure is substantially fluid tight to define a fluid tight space about the coiled pipe.

26. The ship of claim 22 wherein the side structures each include:

a web frame;

plating covering an exterior side of the web frame;

a plurality of longitudinally extending ribs extending at right angles relative to the web frame, each of the plurality of ribs having a T-shape in cross section including a main upstanding wall and a pair of flanges extending from the main upstanding wall and forming the T-shape relative to the main upstanding wall, each rib being substantially symmetrical about the main upstanding wall relative to the plating;

collars sealing any penetrations where the plurality of ribs pass through the web frame; and a strap extending over the plurality of ribs and connected to the pair of flanges of each rib; and wherein the deck structure and the bottom structure each include:

a transverse girder;

plating covering an exterior side of the transverse girder;

a plurality of longitudinally extending ribs extending at right angles relative to the transverse girder, each of the plurality of ribs having a T-shape in cross section including a main upstanding wall and a pair of flanges extending from the main upstanding wall and forming the T-shape relative to the main upstanding wall, each rib being positioned to define a substantial symmetry about the main upstanding wall relative to the plating;

collars sealing any penetrations where the plurality of ribs pass through the transverse girder; and a strap extending over the plurality of ribs and connected to the pair of flanges of each rib.

27. A ship for transporting gas comprising:

a ship structure including a hull including a port side structure, a starboard side structure, a deck structure and a bottom structure; a forward end bulkhead; and a rear end bulkhead; and a middle transverse bulkhead spaced between the forward end bulkhead and the rear end bulkhead, the middle transverse bulkhead including:

a) at least one stack of gas storage containers, each stack including a lowermost gas storage container and an uppermost gas storage container, each of the uppermost gas storage container and the lowermost gas storage container including a construction including: an enclosure and a cargo gas storage pipe within the enclosure, the cargo gas storage pipe being a substantially continuous pipe coiled in plural layers, each of said plural layers including plural loops of said pipe; and b) connections configured to integrate the at least one stack of gas storage containers into the ship structure including (i) connections between the enclosures of the at least one stack of gas storage containers and each of the port side structure and the starboard side structure, (ii) a connection between the enclosure of the uppermost gas storage container and the deck structure, and (iii) a connection between the enclosure of the lowermost gas storage container and the bottom structure, wherein the port side structure includes a stringer extending longitudinally thereon, the stringer having an inner edge that is scalloped to form an indented portion of the stringer and the middle transverse bulkhead is integrated into the indented portion of the stringer.

28. The ship of claim 27 further comprising a longitudinal bulkhead extending at least from the forward end bulkhead to the rear end bulkhead, the longitudinal bulkhead including:

a plurality of stacks of gas storage containers including a selected one of the least one stack of gas storage containers, a rearmost stack and a forwardmost stack, each of the plurality of stacks of gas storage containers including container enclosures, the plurality of stacks of gas storage containers being substantially axially aligned between the forward end bulkhead and the rear end bulkhead; and integral connections configured to integrate the plurality of stacks of gas storage containers into the ship structure including (i) series connections between the container enclosures of the plurality of stacks of gas storage containers in series, (ii) upper and lower connections between the container enclosures of the plurality of stacks of gas storage containers and each of the deck structure and the bottom structure, (iii) a rear connection between the container enclosure of the rearmost gas storage container and the rear end bulkhead, and (iv) a forward connection between the container enclosure of the forwardmost gas storage container and the front end bulkhead.

29. The ship of claim 27 wherein the enclosures are filled with and surrounded by an inert gas.

30. The ship of claim 27 wherein the enclosures each include a main support formed as a reel and the pipe is coiled about the reel and wherein the enclosure is substantially fluid tight to define a fluid tight space about the coiled pipe.

31. The ship of claim 27 wherein the side structures each include:

a web frame;

plating covering an exterior side of the web frame;

a plurality of longitudinally extending ribs extending at right angles relative to the web frame, each of the plurality of ribs having a T-shape in cross section including a main upstanding wall and a pair of flanges extending from the main upstanding wall and forming the T-shape relative to the main upstanding wall, each rib being substantially symmetrical about the main upstanding wall relative to the plating;

collars sealing any penetrations where the plurality of ribs pass through the web frame; and a strap extending over the plurality of ribs and connected to the pair of flanges of each rib; and wherein the deck structure and the bottom structure each include:

a transverse girder;

plating covering an exterior side of the transverse girder;

a plurality of longitudinally extending ribs extending at right angles relative to the transverse girder, each of the plurality of ribs having a T-shape in cross section including a main upstanding wall and a pair of flanges extending from the main upstanding wall and forming the T-shape relative to the main upstanding wall, each rib being positioned to define a substantial symmetry about the main upstanding wall relative to the plating;

collars sealing any penetrations where the plurality of ribs pass through the transverse girder; and a strap extending over the plurality of ribs and connected to the pair of flanges of each rib.

32. A ship for transporting gas comprising:

a ship structure including a hull including a port side structure, a starboard side structure, a deck structure and a bottom structure; a forward end bulkhead; and a rear end bulkhead, wherein the port side and starboard side structures each include:

a web frame;

plating covering an exterior side of the web frame;

a plurality of longitudinally extending ribs extending at right angles relative to the web frame, each of the plurality of ribs having a T-shape in cross section including a main upstanding wall and a pair of flanges extending from the main upstanding wall and forming the T-shape relative to the main upstanding wall, each rib being substantially symmetrical about the main upstanding wall relative to the plating;

collars sealing any penetrations where the plurality of ribs pass through the web frame; and a strap extending over the plurality of ribs and connected to the pair of flanges of each rib; and wherein the deck structure and the bottom structure each include:

a transverse girder;

plating covering an exterior side of the transverse girder;

a plurality of longitudinally extending ribs extending at right angles relative to the transverse girder, each of the plurality of ribs having a T-shape in cross section including a main upstanding wall and a pair of flanges extending from the main upstanding wall and forming the T-shape relative to the main upstanding wall, each rib being positioned to define a substantial symmetry about the main upstanding wall relative to the plating;

collars sealing any penetrations where the plurality of ribs pass through the transverse girder; and a strap extending over the plurality of ribs and connected to the pair of flanges of each rib; and a middle transverse bulkhead spaced between the forward end bulkhead and the rear end bulkhead, the middle transverse bulkhead including:

at least one stack of gas storage containers, each stack including a lowermost gas storage container and an uppermost gas storage container, each of the uppermost gas storage container and the lowermost gas storage container including a construction including: an enclosure and a cargo gas storage pipe within the enclosure, the cargo gas storage pipe being a substantially continuous pipe coiled in plural layers, each of said plural layers including plural loops of said pipe; and connections configured to integrate the at least one stack of gas storage containers into the ship structure including (i) connections between the enclosures of the at least one stack of gas storage containers and each of the port side structure and the starboard side structure, (ii) a connection between the enclosure of the uppermost gas storage container and the deck structure, and (iii) a connection between the enclosure of the lowermost gas storage container and the bottom structure.

33. The ship of claim 32 further comprising a longitudinal bulkhead extending at least from the forward end bulkhead to the rear end bulkhead, the longitudinal bulkhead including:

a plurality of stacks of gas storage containers including a selected one of the least one stack of gas storage containers, a rearmost stack and a forwardmost stack, each of the plurality of stacks of gas storage containers including container enclosures, the plurality of stacks of gas storage containers being substantially axially aligned between the forward end bulkhead and the rear end bulkhead; and integral connections configured to integrate the plurality of stacks of gas storage containers into the ship structure including (i) series connections between the container enclosures of the plurality of stacks of gas storage containers in series, (ii) upper and lower connections between the container enclosures of the plurality of stacks of gas storage containers and each of the deck structure and the bottom structure, (iii) a rear connection between the container enclosure of the rearmost gas storage container and the rear end bulkhead, and (iv) a forward connection between the container enclosure of the forwardmost gas storage container and the front end bulkhead.

34. The ship of claim 32 wherein the enclosures are filled with and surrounded by an inert gas.

35. The ship of claim 32 wherein the enclosures each include a main support formed as a reel and the pipe is coiled about the reel and wherein the enclosure is substantially fluid tight to define a fluid tight space about the coiled pipe.

* * * * *